US008343560B2

(12) United States Patent
Blythe et al.

(10) Patent No.: US 8,343,560 B2
(45) Date of Patent: Jan. 1, 2013

(54) MODULAR CONTAINER ASSEMBLY AND MERCHANDIZING CONTAINER DISPLAY

(75) Inventors: James S. Blythe, Libertyville, IL (US); Toby R. Thomas, Pleasant Prairie, WI (US); Robert Peterson, Crystal Lake, IL (US); Donald A. Lehman, Chicago, IL (US); Reiner Jargosh, Albuquerque, NM (US)

(73) Assignee: Reynolds Consumer Products Inc., Lake Forest, IL (US)

( * ) Notice: Subject to any disclaimer, the term of this patent is extended or adjusted under 35 U.S.C. 154(b) by 1681 days.

(21) Appl. No.: 11/528,830

(22) Filed: Sep. 28, 2006

(65) Prior Publication Data

US 2007/0172554 A1 Jul. 26, 2007

Related U.S. Application Data

(60) Provisional application No. 60/722,090, filed on Sep. 30, 2005.

(51) Int. Cl.
*A23B 7/148* (2006.01)
*B65D 6/28* (2006.01)

(52) U.S. Cl. ..... 426/106; 220/4.21

(58) Field of Classification Search ..... 220/4.21; D9/721; 426/106
See application file for complete search history.

(56) References Cited

U.S. PATENT DOCUMENTS

| | | | |
|---|---|---|---|
| 2,260,651 | A | 10/1941 | Annen |
| 2,720,332 | A | 10/1955 | Holt |
| 2,738,915 | A | 3/1956 | St. Clair |
| 2,798,631 | A | 7/1957 | Engel |
| 2,986,300 | A | 5/1961 | Parrish |
| 2,999,611 | A | 9/1961 | Paulson |
| 3,007,602 | A | 11/1961 | Frank |
| 3,049,259 | A | 8/1962 | Mazzi et al. |
| 3,459,356 | A | 8/1969 | Sparks |
| 3,520,440 | A | 7/1970 | Kinnavy et al. |
| 3,565,146 | A | 2/1971 | Arnolds |
| 3,572,413 | A | 3/1971 | Livingstone |
| 3,620,403 | A | 11/1971 | Rump |

(Continued)

FOREIGN PATENT DOCUMENTS

BE 740346 10/1969

(Continued)

OTHER PUBLICATIONS

PCT International Search Report for International Application No. PCT/US03/33372, dated Mar. 19, 2004 (4 pages).

(Continued)

*Primary Examiner* — Rena Dye
*Assistant Examiner* — Chaim Smith
(74) *Attorney, Agent, or Firm* — Nixon Peabody LLP

(57) ABSTRACT

A modular container assembly comprises first, second and third containers. Each of the containers includes a continuous body portion and a rim. The rim encompasses and projects laterally outwardly from the body portion. The rim has a first feature projecting generally upwardly therefrom and a corresponding second feature being adapted to be releasably engageable with another one of the first feature. The rims of the containers are substantially identical. The containers are releasably engaged to each other by fitting respective upwardly-projecting features into the corresponding feature of another container or into the upwardly-projecting feature of another container. At least one of the first, second and third containers is inverted with respect to the remaining containers so as to form a modular container assembly.

32 Claims, 37 Drawing Sheets

U.S. PATENT DOCUMENTS

| | | | | |
|---|---|---|---|---|
| 3,664,538 | A | 5/1972 | Fioretti | |
| 3,902,540 | A | 9/1975 | Commisso | |
| 3,933,295 | A | 1/1976 | Congleton | |
| 3,938,726 | A | 2/1976 | Holden, Jr. et al. | |
| 3,938,727 | A | 2/1976 | Andersson | |
| 3,982,651 | A | 9/1976 | Braun et al. | |
| 4,014,450 | A | 3/1977 | Girotti et al. | |
| 4,114,668 | A | 9/1978 | Hickey | |
| 4,124,141 | A | 11/1978 | Armentrout et al. | |
| 4,149,578 | A | 4/1979 | Hickey | |
| 4,171,062 | A | 10/1979 | Allen et al. | |
| 4,180,179 | A | 12/1979 | Hoenig et al. | |
| 4,195,746 | A | 4/1980 | Cottrell | |
| 4,201,301 | A | 5/1980 | Aggio | |
| 4,201,311 | A | 5/1980 | Underwood | |
| 4,216,763 | A | 8/1980 | Miklas | |
| 4,238,047 | A | 12/1980 | Helms et al. | |
| 4,266,689 | A | 5/1981 | Asher | |
| 4,294,371 | A | 10/1981 | Davis | |
| 4,307,817 | A | 12/1981 | Cotroneo | |
| 4,334,631 | A | 6/1982 | Ballester | |
| 4,350,263 | A | 9/1982 | Hoffman | |
| 4,360,118 | A | 11/1982 | Stern | |
| 4,362,265 | A | 12/1982 | Williams | |
| 4,378,895 | A | 4/1983 | Woinarski | |
| 4,388,998 | A | 6/1983 | Underwood et al. | 220/307 |
| 4,394,922 | A | 7/1983 | Wimmer | 215/300 |
| 4,397,404 | A | 8/1983 | Blanchette | 220/306 |
| 4,446,986 | A | 5/1984 | Bowen et al. | 220/307 |
| 4,457,432 | A | 7/1984 | Solheim | 206/503 |
| 4,458,825 | A | 7/1984 | Holota | 220/307 |
| 4,487,326 | A | 12/1984 | Uhlig | 215/307 |
| 4,520,943 | A | 6/1985 | Nielsen | 220/281 |
| 4,524,882 | A | 6/1985 | Buc | 220/306 |
| 4,555,043 | A | 11/1985 | Bernhardt | 220/306 |
| 4,664,254 | A | 5/1987 | Sitwell et al. | 206/1.7 |
| 4,741,434 | A | 5/1988 | Liebman | 206/38 |
| 4,765,500 | A | 8/1988 | Ingram | 220/4 |
| 4,811,550 | A | 3/1989 | Hautemont | 53/478 |
| 4,819,824 | A | 4/1989 | Longbottom et al. | 220/266 |
| 4,838,444 | A | 6/1989 | Bitel | 220/4 |
| 4,848,579 | A * | 7/1989 | Barnes et al. | 206/508 |
| 4,854,472 | A | 8/1989 | Semersky | 220/306 |
| 4,856,707 | A | 8/1989 | Lorenz | |
| 4,878,595 | A | 11/1989 | Uhlig | 220/306 |
| 4,890,740 | A | 1/1990 | Tabler | 206/509 |
| 4,923,704 | A * | 5/1990 | Levinson | 426/243 |
| 4,930,636 | A | 6/1990 | Meadows | 206/503 |
| 4,971,774 | A | 11/1990 | Schwanke et al. | 422/310 |
| 4,974,738 | A | 12/1990 | Kidd et al. | |
| 5,036,980 | A | 8/1991 | Vigue et al. | 206/515 |
| 5,042,674 | A | 8/1991 | Ramsay et al. | 220/4.24 |
| 5,060,851 | A | 10/1991 | Lorenz | |
| 5,069,354 | A | 12/1991 | Tannenbaum | 220/4.22 |
| 5,097,977 | A | 3/1992 | Straub | 220/307 |
| 5,161,711 | A | 11/1992 | Picozza et al. | 220/282 |
| 5,170,905 | A | 12/1992 | Luch | 220/276 |
| 5,181,626 | A | 1/1993 | Daenen et al. | 220/282 |
| D339,741 | S | 9/1993 | Lorenz | |
| 5,265,749 | A | 11/1993 | Zutler | 220/4.24 |
| 5,273,174 | A | 12/1993 | Fisher | |
| 5,303,839 | A | 4/1994 | Blumenschein | 220/306 |
| 5,310,070 | A | 5/1994 | Haas et al. | 220/4.24 |
| 5,332,114 | A | 7/1994 | Sano et al. | 220/4.24 |
| 5,356,023 | A | 10/1994 | Krupa | 220/4.24 |
| 5,377,860 | A | 1/1995 | Littlejohn et al. | 220/306 |
| 5,379,934 | A | 1/1995 | Lorenz | |
| 5,388,714 | A | 2/1995 | Zutler | 220/4.24 |
| 5,390,807 | A | 2/1995 | Galaburda | 220/4.24 |
| 5,437,386 | A | 8/1995 | Von Holdt | 220/306 |
| 5,437,388 | A | 8/1995 | Bartelt et al. | |
| 5,605,231 | A | 2/1997 | Borsboom et al. | 206/551 |
| 5,634,559 | A | 6/1997 | Foos et al. | 206/518 |
| 5,666,875 | A | 9/1997 | Wener | 99/422 |
| 5,785,203 | A | 7/1998 | Arshinoff et al. | 220/783 |
| 5,875,918 | A | 3/1999 | Sheffler | 220/783 |
| 5,979,687 | A | 11/1999 | Hayes et al. | |
| 5,992,679 | A | 11/1999 | Porchia et al. | 220/782 |
| 6,021,917 | A | 2/2000 | Lovell et al. | 220/782 |
| 6,029,803 | A | 2/2000 | Ovadia et al. | |
| 6,250,494 | B1 | 6/2001 | Diamond | 220/783 |
| 6,260,723 | B1 | 7/2001 | Bergholtz | 215/344 |
| 6,491,185 | B1 | 12/2002 | Azzarello et al. | 220/783 |
| 6,886,704 | B2 | 5/2005 | Hayes et al. | |
| 2002/0175164 | A1 | 11/2002 | Dees et al. | |
| 2003/0057207 | A1 | 3/2003 | Wong | |
| 2004/0074902 | A1 * | 4/2004 | Hayes et al. | 220/4.21 |

FOREIGN PATENT DOCUMENTS

| | | |
|---|---|---|
| DE | 2349382 | 4/1975 |
| JP | 48-7205 | 2/1973 |
| JP | 51-81203 | 6/1976 |
| JP | 58-3456 | 1/1983 |
| JP | 59-11852 | 4/1984 |
| JP | 63-34069 | 3/1988 |
| JP | 63-62315 | 4/1988 |
| JP | 64-20462 | 2/1989 |
| JP | 2269665 | 11/1990 |
| JP | 8053148 | 2/1996 |
| JP | 11059711 | 3/1999 |
| JP | 20012405 | 1/2001 |
| JP | 2002166951 | 6/2002 |
| WO | WO 2006/088479 A | 2/1973 |

OTHER PUBLICATIONS

English translation of Belgian Patent No. 740,346 dated Oct. 16, 1969 (8 pages).

PCT International Search Report corresponding to International Application No. PCT/US2006/038422, dated Apr. 13, 2007 (8 pages).

Written Opinion corresponding to International Application No. PCT/US2006/038422, dated Apr. 13, 2007 (8 pages).

* cited by examiner

MODULAR CONTAINER ASSEMBLY AND MERCHANDIZING CONTAINER DISPLAY

CROSS-REFERENCE TO RELATED APPLICATION

This application claims the benefit of the U.S. Provisional Application 60/722,090 filed on Sep. 30, 2005 and entitled "Modular Container Assembly And Merchandizing Container Display" and this provisional application is hereby incorporated by reference in its entirety.

FIELD OF INVENTION

The present invention relates generally to containers. More particularly, the present invention relates to a modular container assembly and a merchandising container display.

BACKGROUND OF THE INVENTION

The use of inexpensive polymeric, paper or metal packaging containers has become popular, especially for preparing and serving various food products. Polymeric, paper and metal containers generally have been used for heating the food product(s) disposed therein. These containers typically comprise a cover or lid and a base.

It would be desirable to have a container assembly that would be easy for the customer to close and open. It would also be desirable to provide a container assembly that is releasably engageable and prevents or inhibits material, such as liquid, from leaving the container assembly. It would also be desirable for the container assembly to be able to hold two different types of items such as food.

It would also be desirable to provide a container that is easy to manufacture and reduces the inventory requirement of customers that purchase the containers. It would also be desirable to produce a container that stacks efficiently so as to reduce the costs associated with shipping and storing the containers.

SUMMARY OF THE INVENTION

According to one embodiment, a modular container assembly comprises a first container, a second container and a third container. The first container includes a first continuous body portion and a first rim. The first rim encompasses and projects laterally outwardly from the first body portion. The first rim has a first feature projecting generally upwardly therefrom and a corresponding second feature being adapted to be releasably engageable with another one of the first feature. The second container includes a second continuous body portion and a second rim. The second rim encompasses and projects laterally outwardly from the second body portion. The second rim has a third feature projecting generally upwardly therefrom and a corresponding fourth feature being adapted to be releasably engageable with another one of the third feature. The third container includes a third continuous body portion and a third rim. The third rim encompasses and projects laterally outwardly from the third body portion. The third rim has a fifth feature projecting generally upwardly therefrom and a corresponding sixth feature being adapted to be releasably engageable with another one of the fifth feature. The first rim, the second rim, and the third rim are substantially identical. The first container, the second container, and the third container are releasably engaged to each other by fitting respective first, third and fifth upwardly-projecting features into the corresponding second, fourth or sixth feature of another container or into the first, third or fifth upwardly-projecting feature of another container. At least one of the first container, second container, and third container is inverted with respect to the remaining containers so as to form a modular container assembly.

According to another embodiment, a modular container assembly, which contains and holds food, comprises a first container, a second container and a third container. The first container includes a first continuous body portion and a first rim. The first rim encompasses and projects laterally outwardly from the first body portion. The first rim has a first feature projecting generally upwardly therefrom and a corresponding second feature being adapted to be releasably engageable with another one of the first feature. The second container includes a second continuous body portion and a second rim. The second rim encompasses and projects laterally outwardly from the second body portion. The second rim has a third feature projecting generally upwardly therefrom and a corresponding fourth feature being adapted to be releasably engageable with another one of the third feature. The third container includes a third continuous body portion and a third rim. The third rim encompasses and projects laterally outwardly from the third body portion. The third rim has a fifth feature projecting generally upwardly therefrom and a corresponding sixth feature being adapted to be releasably engageable with another one of the fifth feature. The first rim, the second rim, and the third rim are substantially identical. The first container, the second container, and the third container are releasably engagable to each other by fitting respective first, third and fifth upwardly-projecting features into the corresponding second, fourth or sixth feature of another container or into the first, third or fifth upwardly-projecting feature of another container. At least one of the first container, second container, and third container is inverted with respect to the remaining containers so as to form a modular container assembly with a first area being formed between the first container and the second container, and a second area being formed between the second container and the third container. The first area and the second area are distinct from each other. The first area contains a first food and the second area contains a second food.

According to one method, a modular container assembly is formed. A first container, a second container and a third container are provided. The first container includes a first continuous body portion and a first rim. The first rim encompasses and projects laterally outwardly from the first body portion. The first rim has a first feature projecting generally upwardly therefrom and a corresponding second feature being adapted to be releasably engageable with another one of the first feature. The second container includes a second continuous body portion and a second rim. The second rim encompasses and projects laterally outwardly from the second body portion. The second rim has a third feature projecting generally upwardly therefrom and a corresponding fourth feature being adapted to be releasably engageable with another one of the third feature. The third container includes a third continuous body portion and a third rim. The third rim encompasses and projects laterally outwardly from the third body portion. The third rim has a fifth feature projecting generally upwardly therefrom and a corresponding sixth feature being adapted to be releasably engageable with another one of the fifth feature. The first rim, the second rim, and the third rim are substantially identical.

The first container and the second container are aligned such that the first rim and the second rim are adjacent to each other. The first upwardly-projecting feature is fit into the corresponding fourth feature of the second container or is fit into the third upwardly-projecting feature of the second container such that the first and second containers are releasably engaged to each other and form a first area. The third container is positioned in an inverted position relative to the first container. The second container and the third container are aligned such that the second rim and the third rim are adjacent to each other. The fifth upwardly-projecting feature of the third container is fit into the corresponding fourth feature of the second container or is fit into the third upwardly-projecting feature of the second container such that the first and second containers are releasably engaged to each other and form a second area.

According to a further embodiment, a modular container assembly comprises a first container, a second container, a third container and a fourth container. The first container includes a first continuous body portion and a first rim. The first rim encompasses and projects laterally outwardly from the first body portion. The first rim has a first feature projecting generally upwardly therefrom and a corresponding second feature being adapted to be releasably engageable with another one of the first feature. The second container includes a second continuous body portion and a second rim. The second rim encompasses and projects laterally outwardly from the second body portion. The second rim has a third feature projecting generally upwardly therefrom and a corresponding fourth feature being adapted to be releasably engageable with another one of the third feature.

The third container includes a third continuous body portion and a third rim. The third rim encompasses and projects laterally outwardly from the third body portion. The third rim has a fifth feature projecting generally upwardly therefrom and a corresponding sixth feature being adapted to be releasably engageable with another one of the fifth feature. The fourth container includes a fourth continuous body portion and a fourth rim. The fourth rim encompasses and projects laterally outwardly from the fourth body portion. The fourth rim has a seventh feature projecting generally upwardly therefrom and a corresponding eighth feature being adapted to be releasably engageable with another one of the seventh feature. The first rim, the second rim, the third rim, and the fourth rim are identical. The first container, the second container, the third container, and the fourth container are releasably engagable to each other by fitting respective first, third, fifth and seventh upwardly-projecting features into the corresponding second, fourth, sixth or eighth feature of another container or into the first, third, fifth or seventh upwardly-projecting feature of another container. At least one of the first container, second container, third container, and the fourth container is inverted with respect to the remaining containers so as to form a modular container assembly.

According to yet another embodiment, a modular container assembly, which contains and holds food, comprises a first container, a second container, a third container and a fourth container. The first container includes a first continuous body portion and a first rim. The first rim encompasses and projects laterally outwardly from the first body portion. The first rim has a first feature projecting generally upwardly therefrom and a corresponding second feature being adapted to be releasably engageable with another one of the first feature. The second container includes a second continuous body portion and a second rim. The second rim encompasses and projects laterally outwardly from the second body portion. The second rim has a third feature projecting generally upwardly therefrom and a corresponding fourth feature being adapted to be releasably engageable with another one of the third feature.

The third container includes a third continuous body portion and a third rim. The third rim encompasses and projects laterally outwardly from the third body portion. The third rim has a fifth feature projecting generally upwardly therefrom and a corresponding sixth feature being adapted to be releasably engageable with another one of the fifth feature. The fourth container includes a fourth continuous body portion and a fourth rim. The fourth rim encompasses and projects laterally outwardly from the fourth body portion. The fourth rim has a seventh feature projecting generally upwardly therefrom and a corresponding eighth feature being adapted to be releasably engageable with another one of the seventh feature. The first rim, the second rim, the third rim, and the fourth rim are identical.

The first container, the second container, the third container, and the fourth container are releasably engagable to each other by fitting respective first, third, fifth and seventh upwardly-projecting features into the corresponding second, fourth, sixth or eighth feature of another container or into the first, third, fifth or seventh upwardly-projecting feature of another container. At least one of the first container, second container, third container, and the fourth container is inverted with respect to the remaining containers so as to form a modular container assembly with a first area being formed between the first container and the second container, a second area being formed between the second container and the third container, and a third area being formed between the third container and the fourth container. The first area, the second area and the third area are distinct from each other. The first area contains a first food. The second area contains a second food and the third area contains a third food.

According to another method, a modular container assembly is formed. A first container, a second container, a third container and a fourth container are provided. The first container includes a first continuous body portion and a first rim. The first rim encompasses and projects laterally outwardly from the first body portion. The first rim has a first feature projecting generally upwardly therefrom and a corresponding second feature being adapted to be releasably engageable with another one of the first feature. The second container includes a second continuous body portion and a second rim. The second rim encompasses and projects laterally outwardly from the second body portion. The second rim has a third feature projecting generally upwardly therefrom and a corresponding fourth feature being adapted to be releasably engageable with another one of the third feature.

The third container includes a third continuous body portion and a third rim. The third rim encompasses and projects laterally outwardly from the third body portion. The third rim has a fifth feature projecting generally upwardly therefrom and a corresponding sixth feature being adapted to be releasably engageable with another one of the fifth feature. The fourth container includes a fourth continuous body portion and a fourth rim. The fourth rim encompasses and projects laterally outwardly from the fourth body portion. The fourth rim has a seventh feature projecting generally upwardly therefrom and a corresponding eighth feature being adapted to be releasably engageable with another one of the seventh feature. The first rim, the second rim, the third rim and the fourth rim are substantially identical.

The first container and the second container are aligned such that the first rim and the second rim are adjacent to each other. The first upwardly-projecting feature is fit into the corresponding fourth feature of the second container or is fit into the third upwardly-projecting feature of the second container such that the first and second containers are releasably engaged to each other and form a first area. The second container and the third container are aligned such that the second rim and the third rim are adjacent to each other. The third upwardly-projecting feature is fit into the corresponding sixth feature of the third container or is fit into the fifth upwardly-projecting feature of the third container such that the second and third containers are releasably engaged to each other and form a second area. The fourth container is positioned in an inverted position relative to the first container. The fourth container and the third container are aligned such that the fourth rim and the third rim are adjacent to each other. The seventh upwardly-projecting feature of the fourth container is fit into the corresponding sixth feature of the third container or is fit into the fifth upwardly-projecting feature of the third container such that the fourth and third containers are releasably engaged to each other and form a third area.

According to another embodiment, a modular container assembly comprises a first container and a second container. The first container includes a first continuous body portion and a first rim. The first rim encompasses and projects laterally outwardly from the first body portion. The first rim has a first feature projecting generally upwardly therefrom and a corresponding second feature being adapted to be releasably engageable with another one of the first feature. The second container includes a second continuous body portion and a second rim. The second rim encompasses and projects laterally outwardly from the second body portion. The second rim has a third feature projecting generally upwardly therefrom and a corresponding fourth feature being adapted to be releasably engageable with another one of the third feature. The first rim and the second rim are substantially identical. The first container and the second container are of different sizes. The first container and the second container are sealingly engagable to each other by fitting the first feature of a first container into the third feature of the second container to form a modular container assembly.

According to yet another embodiment, a modular container assembly comprises a first container and a second container. The first container includes a first continuous body portion and a first rim. The first rim encompasses and projects laterally outwardly from the first body portion. The first rim has a first feature projecting generally upwardly therefrom and a corresponding second feature being adapted to be releasably engageable with another one of the first feature. The second container includes a second continuous body portion and a second rim. The second rim encompasses and projects laterally outwardly from the second body portion. The second rim has a third feature projecting generally upwardly therefrom and a corresponding fourth feature being adapted to be releasably engageable with another one of the third feature. The first rim and the second rim are substantially identical. The first container and the second container are of different sizes. The second container is inverted with respect to the first container. The first container and the second container are sealingly engagable to each other by fitting the first upwardly-projecting feature of the first container into the fourth feature of the second container and by fitting the third upwardly-projecting feature of the second container into the second feature of the first container to form a modular container assembly.

According to one embodiment, a merchandizing container display comprises a plurality of containers. The plurality of containers includes a continuous body portion and a rim. The rim encompasses and projects laterally outwardly from the body portion. The first rim has a first feature projecting generally upwardly therefrom and a corresponding second feature being adapted to be releasably engageable with another one of the first feature. Each of the plurality of containers is releasably engaged to another one of the plurality of containers by fitting the upwardly-projecting feature of a first container into the first upwardly-projecting feature of another one of the containers.

According to another embodiment, a merchandizing container display comprises a plurality of first containers and a plurality of second containers. The plurality of first containers includes a first continuous body portion and a first rim. The first rim encompasses and projects laterally outwardly from the first body portion. The first rim has a first feature projecting generally upwardly therefrom and a corresponding second feature being adapted to be releasably engageable with another one of the first feature. The plurality of second containers includes a second continuous body portion and a second rim. The second rim encompasses and projects laterally outwardly from the second body portion. The second rim has a third feature projecting generally upwardly therefrom and a corresponding fourth feature being adapted to be releasably engageable with another one of the third feature.

The first rim and the second rim are substantially identical. The first container and the second container are of different sizes. Each of the plurality of first containers is releasably engagable to another one of the plurality of first containers by fitting the first upwardly-projecting feature of a first container into the first upwardly-projecting feature of another first container. Each of the plurality of second containers is releasably engagable to another one of the plurality of second containers by fitting the third upwardly-projecting feature of a second container into the third upwardly-projecting feature of another second container.

According to yet another embodiment, a merchandizing container display comprises a plurality of first, second and third containers. The plurality of first containers includes a first continuous body portion and a first rim. The first rim encompasses and projects laterally outwardly from the first body portion. The first rim has a first feature projecting generally upwardly therefrom and a corresponding second feature being adapted to be releasably engageable with another one of the first feature. The plurality of second containers includes a second continuous body portion and a second rim. The second rim encompasses and projects laterally outwardly from the second body portion. The second rim has a third feature projecting generally upwardly therefrom and a corresponding fourth feature being adapted to be releasably engageable with another one of the third feature. The plurality of third containers includes a third continuous body portion and a third rim. The third rim encompasses and projects laterally outwardly from the third body portion. The third rim has a fifth feature projecting generally upwardly therefrom and a corresponding sixth feature being adapted to be releasably engageable with another one of the fifth feature. The first rim, the second rim and the third rims are substantially identical.

The first container, the second container, and the third container are of different sizes. Each of the plurality of first containers is releasably engagable to another one of the plurality of first containers by fitting the first upwardly-projecting feature of a first container into the first upwardly-projecting feature of another first container. Each of the plurality of second containers is releasably engagable to another one of the plurality of second containers by fitting the third upwardly-projecting feature of a second container into the third upwardly-projecting feature of another first container. Each of the plurality of third containers is releasably engagable to another one of the plurality of third containers by fitting the fifth upwardly-projecting feature of a third container into the fifth upwardly-projecting feature of another third container.

According to yet another embodiment, a modular container assembly comprises a first container, a second container and a connecting member. The first container includes a first continuous body portion and a first rim. The first rim encompasses and projects laterally outwardly from the first body portion. The first rim has a first feature. The second container includes a second continuous body portion and a second rim. The second rim encompasses and projects laterally outwardly from the second body portion. The second rim has a second feature. The connecting member is adapted to releasably engage with the first container and an inverted second container. The first container and the second container are substantially identical. The first container and the second container are releasably engaged to each other by fitting respective first and second features of the first and second containers with the connecting member. The second container is inverted with respect to the first container to form a modular container assembly.

Figure 1:
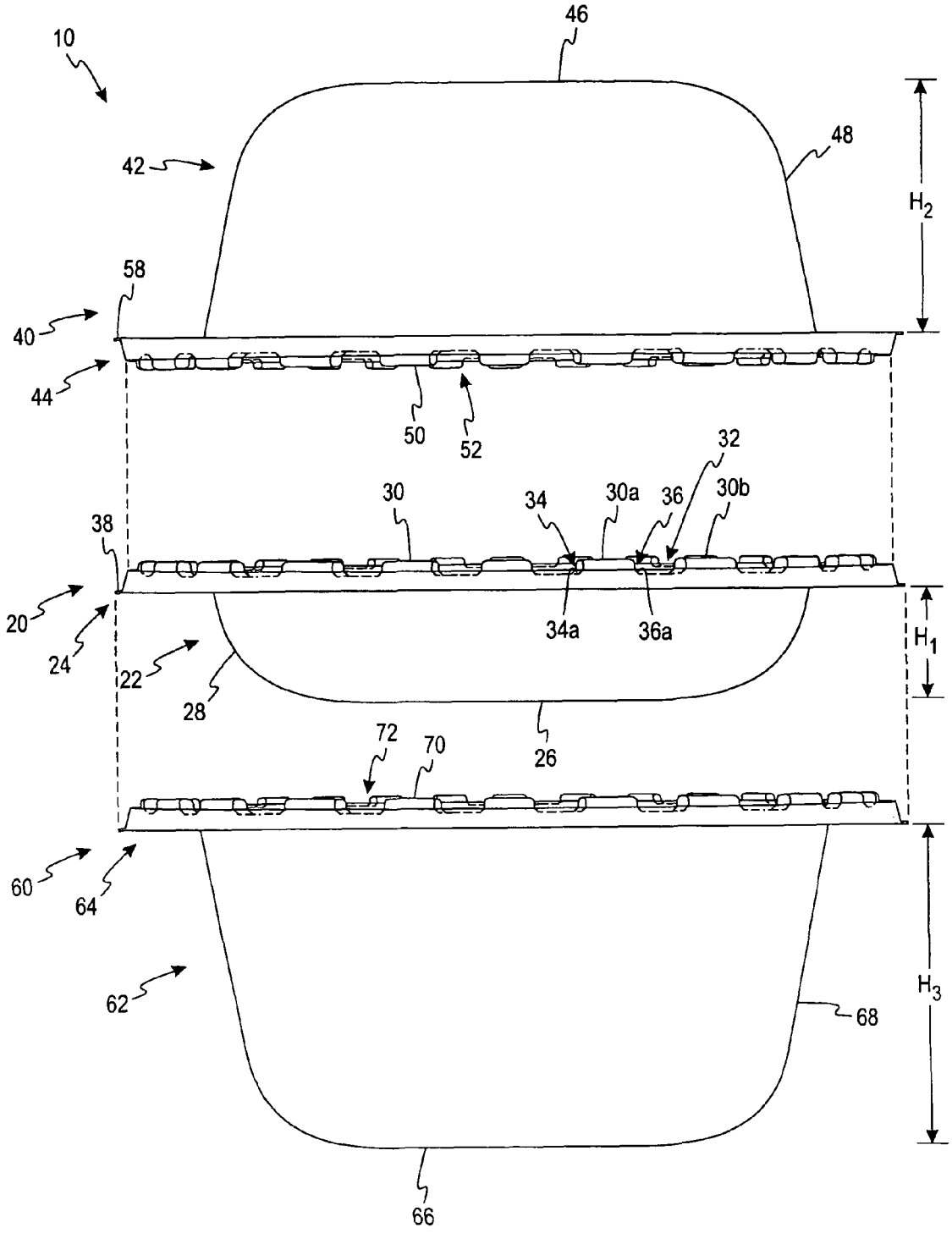
FIG. 1 is an exploded side view of a plurality of containers to be used in forming a modular container assembly according to one embodiment of the invention.

While the invention is susceptible to various modifications and alternative forms, specific embodiments thereof have been shown by way of example in the drawing and will herein be described in detail. It should be understood, however, that it is not intended to limit the invention to the particular forms disclosed but, on the contrary, the intention is to cover all modifications, equivalents, and alternatives falling within the spirit and scope of the invention as defined by the appended claims.

DESCRIPTION OF ILLUSTRATIVE EMBODIMENTS

Referring to FIGS. 1-4, a modular container assembly 10 according to one embodiment of the present invention is shown. The modular container assembly 10 includes a first container 20, a second container 40 and a third container 60. FIG. 1 depicts the modular container assembly 10 in an exploded position, while FIG. 2*a,b* depicts the modular container assembly 10 in an assembled position. It is contemplated that other modular container assemblies may be formed using containers other than those shown in FIGS. 1-4. For example, modular container assemblies may be formed, but are not limited to, using plates, bowls, platters, tubs, single-serve and family-size containers, single-serve and family-size ovenware, and combinations thereof.

The modular container assemblies of the present invention are desirable because of the flexibility or interchangeability of the containers used to form the modular container assembly. This flexibility allows consumers to select container sizes that best fit their needs.

Referring back to FIGS. 1-4, the container 20 includes a continuous body portion 22 and a continuous rim 24 encompassing and projecting laterally outwardly from the body portion 22. The body portion 22 includes a bottom 26 and a continuous sidewall 28 encompassing and projecting upwardly and outwardly from the bottom 26. It is also contemplated that the rim may not be continuous, although it is preferred to be continuous.

Figure 4:
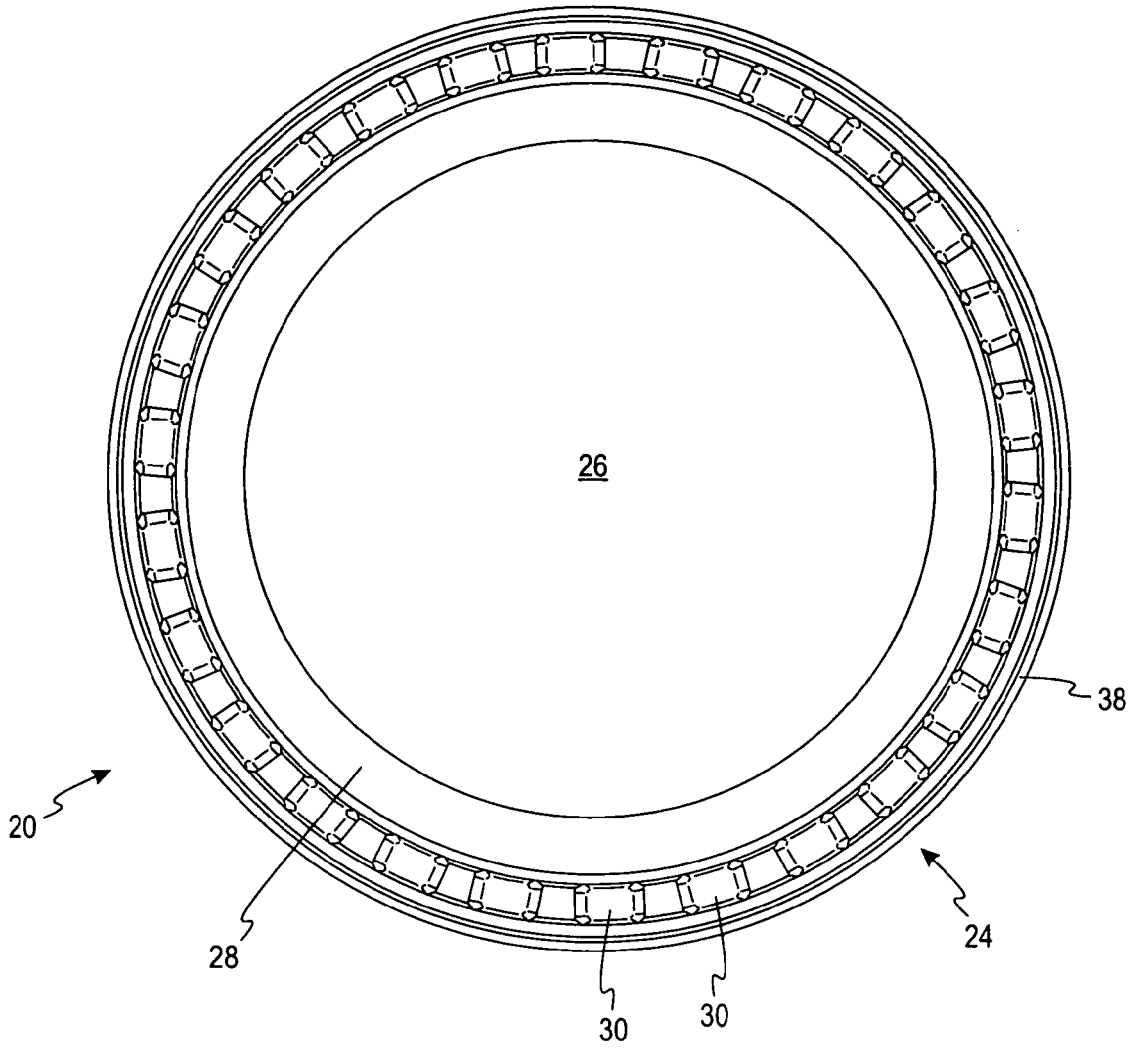
FIG. 4 is a top view of a first container of FIG. 1.

Referring specifically to FIGS. 1 and 4, the continuous rim 24 includes a feature (i.e., plurality of ribs 30) that projects generally upwardly therefrom. The plurality of ribs 30 is spaced around the general periphery of the container 20 and assists in forming a releasably engageable modular container assembly. The orientation of the plurality of ribs 30 creates a pattern that is generally normal to the direction of the rim 24. More specifically, the orientation of the plurality of ribs 30 may create a pattern that is normal to the direction of the rim 24. In a radial configuration with a pattern that is normal to the direction of the rim, each of the plurality of ribs 30, if extended inwardly, would pass through the general center of the plate.

The plurality of ribs 30, however, may be formed in different patterns than shown in FIGS. 1 and 4 with respect to the rim 24 (e.g., diagonally). It may be desirable to form the plurality of ribs 30 in a decorative pattern for aesthetic reasons. Such a decorative feature may assist in "hiding" or disguising the releasable engageable feature in the container 20. The container 20 of FIGS. 1 and 4 has exactly 26 ribs formed in the continuous rim 24. It is contemplated that the number of ribs may vary from that shown in FIGS. 1 and 4. For example, a container may have from about 3 to about 10 ribs. A container may have greater than about 20 or about 40 ribs, and may even have up to or greater than about 60 or 80 ribs. The desired number of ribs formed on the container will often vary depending on factors such as the size or shape of the container assembly, the material(s) type and thicknesses of the container assembly, and the desired holding strength of the modular container assembly. The desired holding strength depends on factors such as the weight of item(s) placed in the modular container assembly and its perceived usage.

Turning to FIG. 1, a first rib 30*a* and a second rib 30*b* with a space 32 being formed therebetween are depicted. The space 32 is adapted to be releasably engageable with one of the plurality of ribs of another container. The first rib 30*a* includes a first sidewall 34 and a second sidewall 36. To provide an improved engageable modular container assembly, at least one of the rib sidewalls may have an undercut. Such an optional undercut formed in the rib sidewall engages a similar undercut in a corresponding space formed between adjacent ribs of a second container when the modular container assembly is formed. As shown in FIG. 1, optional undercuts 34*a*, 36*a* are formed in respective sidewalls 34, 36. The size and shape of the undercut will often vary depending on factors such as the size or shape of the modular container assembly, the material(s) type and thicknesses of the modular container assembly, and the desired holding strength of the modular container assembly. The desired holding strength may depend on factors such as the weight of item(s) placed in the modular container assembly and its perceived usage.

It is contemplated that the ribs may have sidewalls with no undercuts or at least one undercut. It is also contemplated that some ribs within the same container may have no undercuts, while other ribs may have one or more undercuts.

It is contemplated that the upwardly-projecting feature may be shaped differently than the ribs shown in FIGS. 1-4. For example, the upwardly-projecting features may be a plurality of round, oval, square, or polygonal features. It is contemplated that many shapes and sizes may be used in forming the upwardly projecting feature.

Referring to FIGS. 1 and 4, an optional seal feature 38 formed on the rim 24 is depicted and is located outwardly from the rib 30 with respect to the center of the first container 20. In other words, the optional seal feature 38 is located farther away from the center of the first container 20 than the rib 30. The optional seal feature 38 in conjunction with a corresponding optional seal feature on another container (see optional seal feature 58 of container 40 in FIG. 1), along with the engageable feature of the modular container assembly, assists in preventing or inhibiting material from leaving or entering the modular container assembly. The optional seal feature is especially useful in preventing or inhibiting product leakage that may occur due to tolerances within the manufacturing process.

In addition to the first container 20, the modular container assembly includes the second container 40 and the third container 60. The second container 40 includes a continuous body portion 42 and a continuous rim 44 encompassing and projecting laterally outwardly from the body portion 42. The body portion 42 includes a bottom 46 and a continuous sidewall 48 encompassing and projecting upwardly and outwardly from the bottom 46. The continuous rim 44 includes a feature (i.e., plurality of ribs 50) that projects generally upwardly therefrom (in the orientation of FIG. 1, the ribs 50 are projecting downwardly). Each of the plurality of ribs 50 is the same as the plurality of ribs 30 described above. The plurality of ribs 50 has a plurality of spaces 52 formed therebetween. The respective spaces 52 are adapted to be releasably engageable with a respective one of the plurality of ribs 30.

The third container 60 includes a continuous body portion 62 and a continuous rim 64 encompassing and projecting laterally outwardly from the body portion 62. The body portion 62 includes a bottom 66 and a continuous sidewall 68 encompassing and projecting upwardly and outwardly from the bottom 66. The continuous rim 64 includes a feature (i.e., plurality of ribs 70) that projects generally upwardly therefrom. Each of the plurality of ribs 70 is the same as the plurality of ribs 30. The plurality of ribs 70 has a plurality of spaces 72 formed therebetween. The respective spaces 72 are adapted to be releasably engageable with a respective space 32 of container 20.

The containers 20, 40 and 60 of the modular container assembly 10 are of different shapes. Specifically, the height H1 of sidewall 28, the height H2 of sidewall 48 and the height H3 of sidewall 68 are of different lengths. The rims 24, 44 and 64 of respective containers 20, 40 and 60 are identical. It is contemplated that the rims may be substantially identical. The containers 20, 40, 60 of FIGS. 1-4, are depicted as being generally circular.

Figure 21:
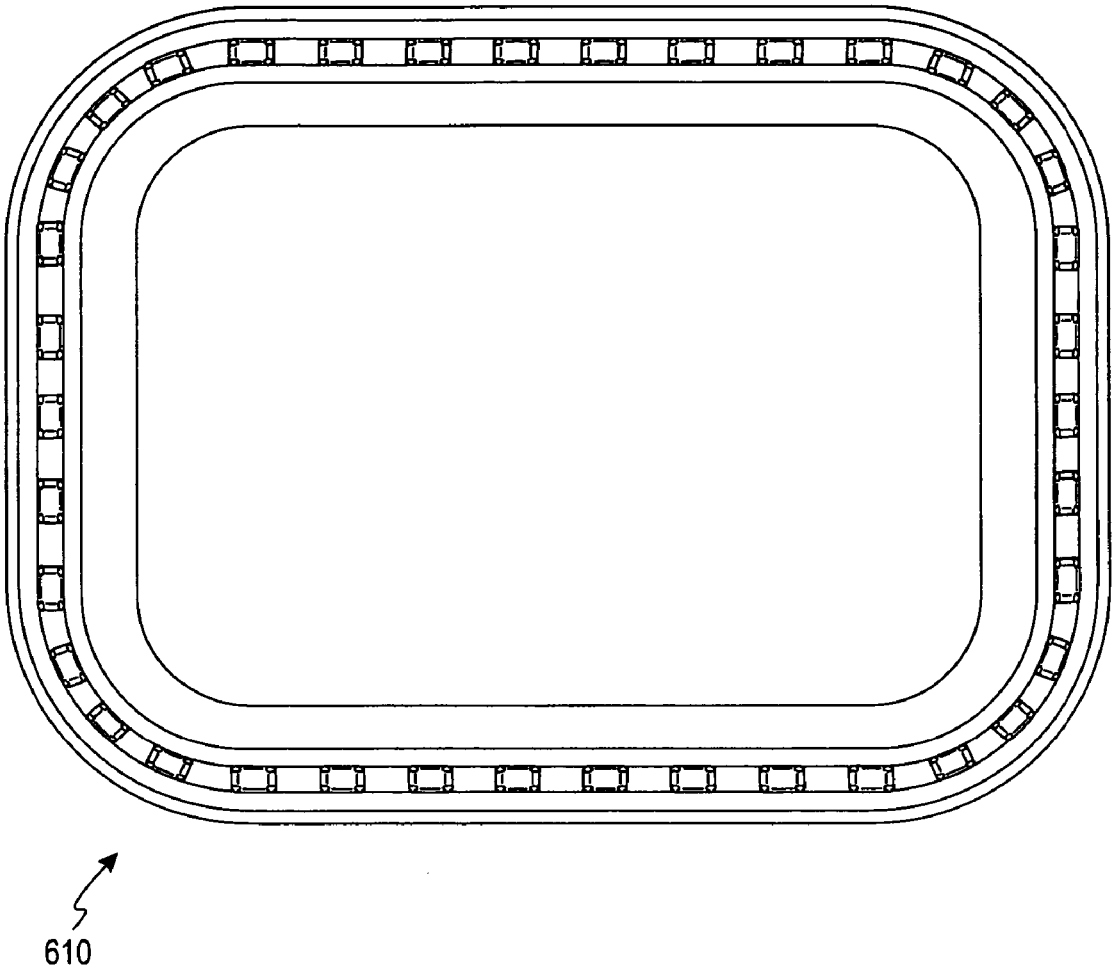
FIG. 21 is a top view of a container with a polygonal shape according to one embodiment.

The height and shape of the containers forming the modular container assembly may vary from that shown without departing from the scope of the invention. It is contemplated that the containers used to form the modular container assembly may be other shapes such as rectangular, square, hexagonal, octagonal, other polygonal shapes, oval, or other non-polygonal shapes. For example, containers used to form a modular container assemblies may be shaped in a polygonal shape (i.e., rectangular) as shown with container 610 of FIG. 21.

To form a modular container assembly, in one embodiment, at least one of the first container, second container, and third container is inverted with respect to the remaining containers. The upwardly-projecting features of respective containers are fit into the corresponding second, fourth or sixth features of another container or into the first, third or fifth upwardly-projecting feature of another container.

As specifically shown in FIGS. 1 and 2, the second container 40 is inverted with respect to the first and third containers 20, 60. Specifically, referring to FIGS. 1 and 3, the plurality of ribs 70 of the third container 60 is fit into a respective one of the plurality of ribs 30 of the first container 20. The plurality of ribs 50 of the second container 40 is fit into respective spaces 32 of the first container 20.

Figure 2A:
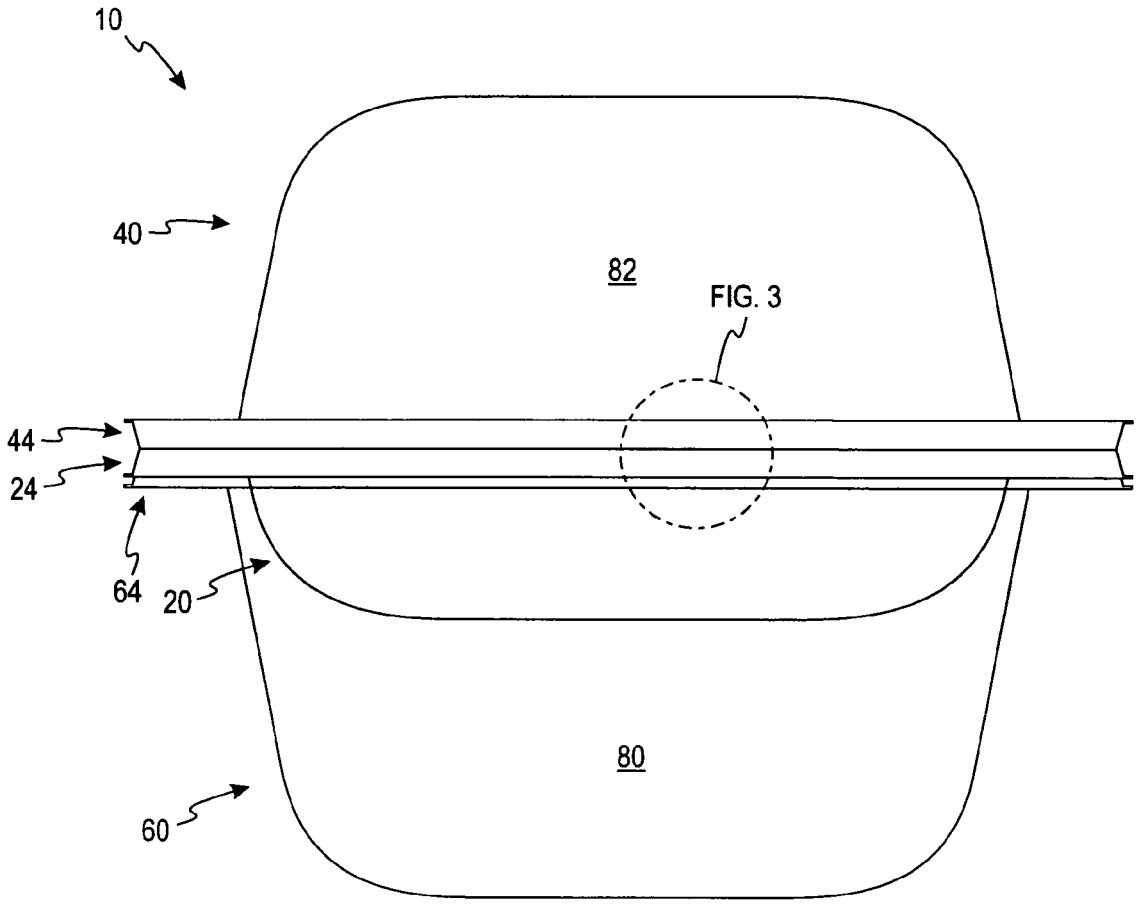
FIG. 2*a* is a side view of the plurality of containers of FIG. 1 in an assembled position.
Figure 2B:
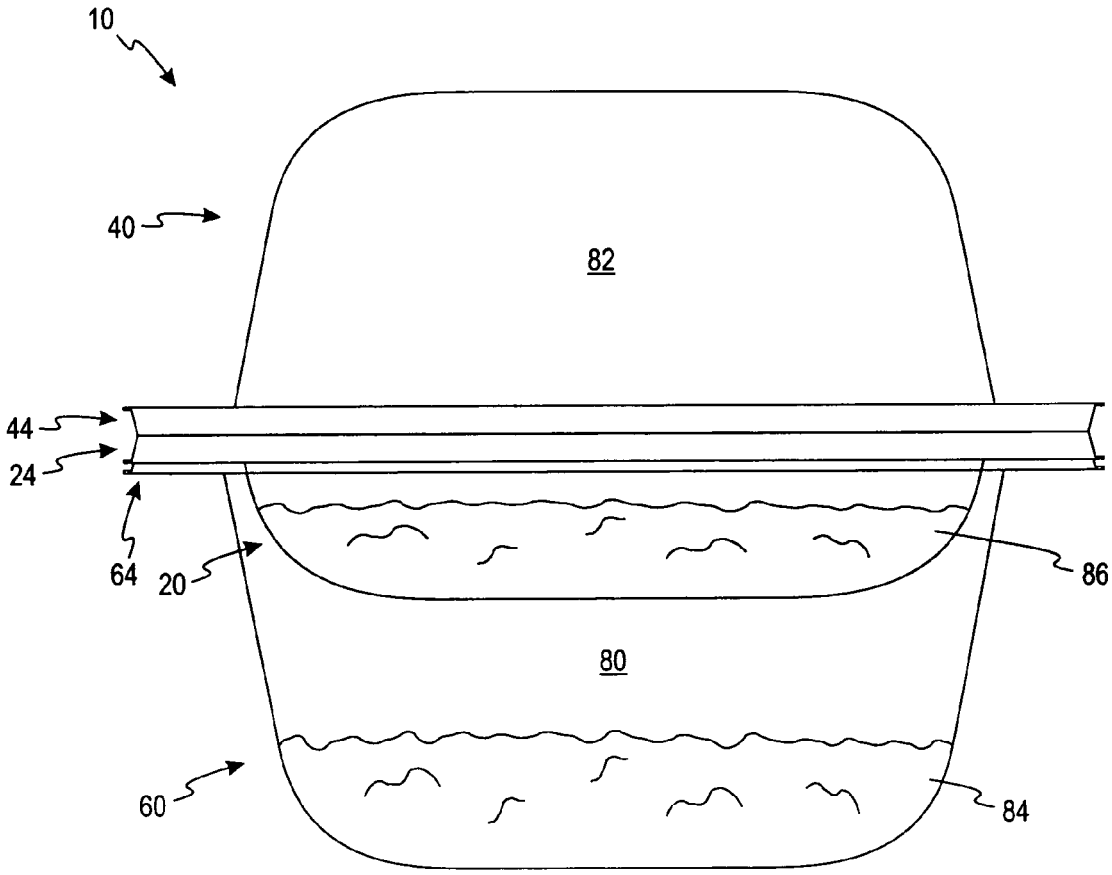
FIG. 2*b* is a side view of the plurality of containers of FIG. 1 in an assembled position with a first item and a second item.
Figure 3:
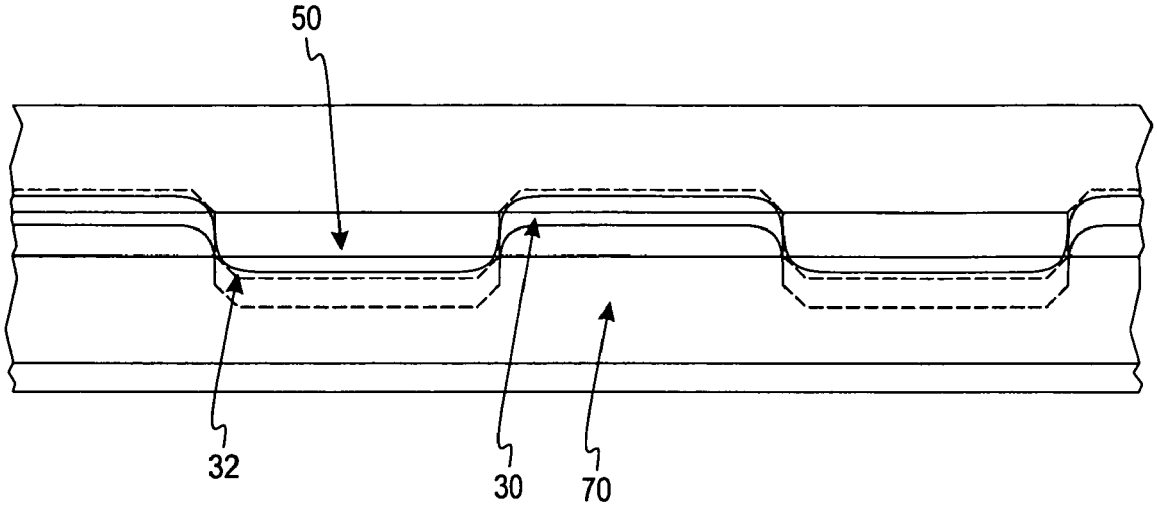
FIG. 3 is an enlarged side view taken of generally circular region FIG. 3 of FIG. 2*a*.

After the modular container assembly 10 is formed into an assembled position, a first area 80 (see FIGS. 2*a*, 2*b*) is formed between the first container 20 and the third container 60, and a second area 82 is formed between the first container 20 and the second container 40. The first area 80 and the second area 82 are distinct from each other. In one embodiment, as shown in FIG. 2*b*, the first area 80 contains a first item 84 and the second area 82 contains a second item 86. The first item 84 may contain a first food item and the second item 86 may contain a second food item. The first and second food items may be the same. It is contemplated that the first food item and the second food item may be different such as, for example, the first food item being spaghetti and the second food item being spaghetti sauce. The first and second foods tend to be related, but it is not necessary that they are related. The first and/or second food items may be a liquid. It is contemplated that other foods may be stored in the modular container assembly 10. The first and second areas 80, 82 of the modular container assembly 10 are desirable because they prevent or inhibit commingling of items. For example, undesirable mixing of food items can corrupt the flavor and the consistency of the food items.

Alternatively, the first item 84 may be a first non-food item and the second item 86 may be a second non-food item. Non-limiting examples of non-food items include household goods, medical supplies, cosmetics or other items. The first and second non-food items may be the same or may be different.

To form the modular container assembly 10, the first container 20, the second container 40 and the third container 60 are provided. The first container 20 and the third container 60 are aligned such that the first rim 24 and the third rim 64 are adjacent to each other. The upwardly-projecting feature (e.g., ribs 70) of the third container 60 is fit into the upwardly-projecting feature (e.g., ribs 30) of the first container 20 such that the first and third containers 20, 60 are releasably engaged to each other and form the first area 80. To fit the ribs 70 into respective ribs 30, the container 20 or the container 60 may have to be rotated slightly such that the ribs are aligned with each other.

The second container 40 is placed in an inverted position relative to the third container 60. For example, the second container 40 may be flipped 180 degrees relative to the third container 60. The first and second containers 20, 40 are aligned such that the rims 24, 44 are adjacent to each other. The upwardly-projecting feature (e.g., ribs 50) of the second container 40 is fit into the corresponding feature (e.g., spaces 32) of the first container 20 such that the first and second containers are releasably engaged to each other and form the second area 82. To fit the ribs 50 into respective spaces 32, the container 40 or the container 20 may have to be rotated slightly such that the ribs are offset (i.e., the ribs and spaces are aligned with each other).

Figure 5:
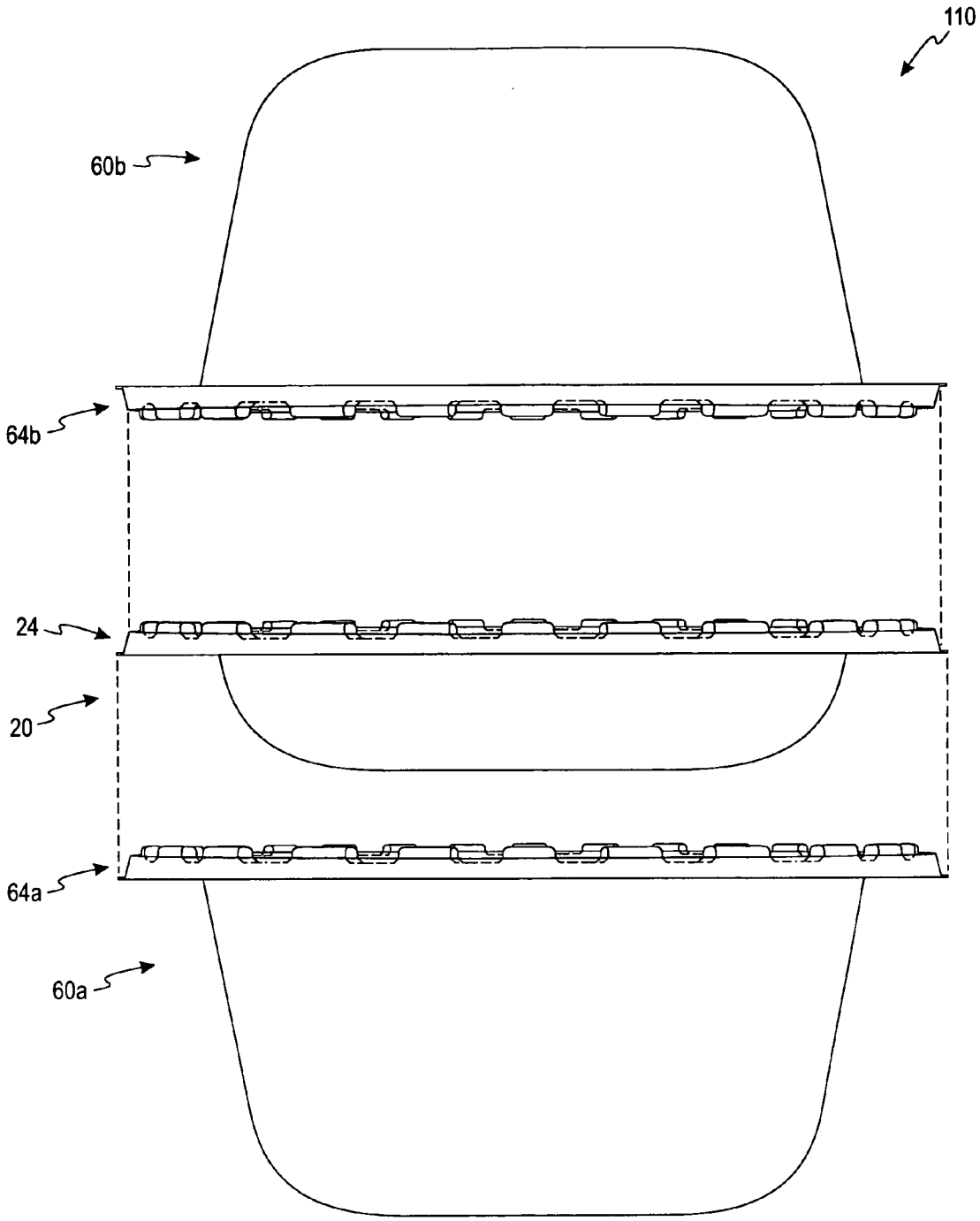
FIG. 5 is an exploded side view of a plurality of containers to be used in forming a modular container assembly according to another embodiment of the invention.
Figure 6:
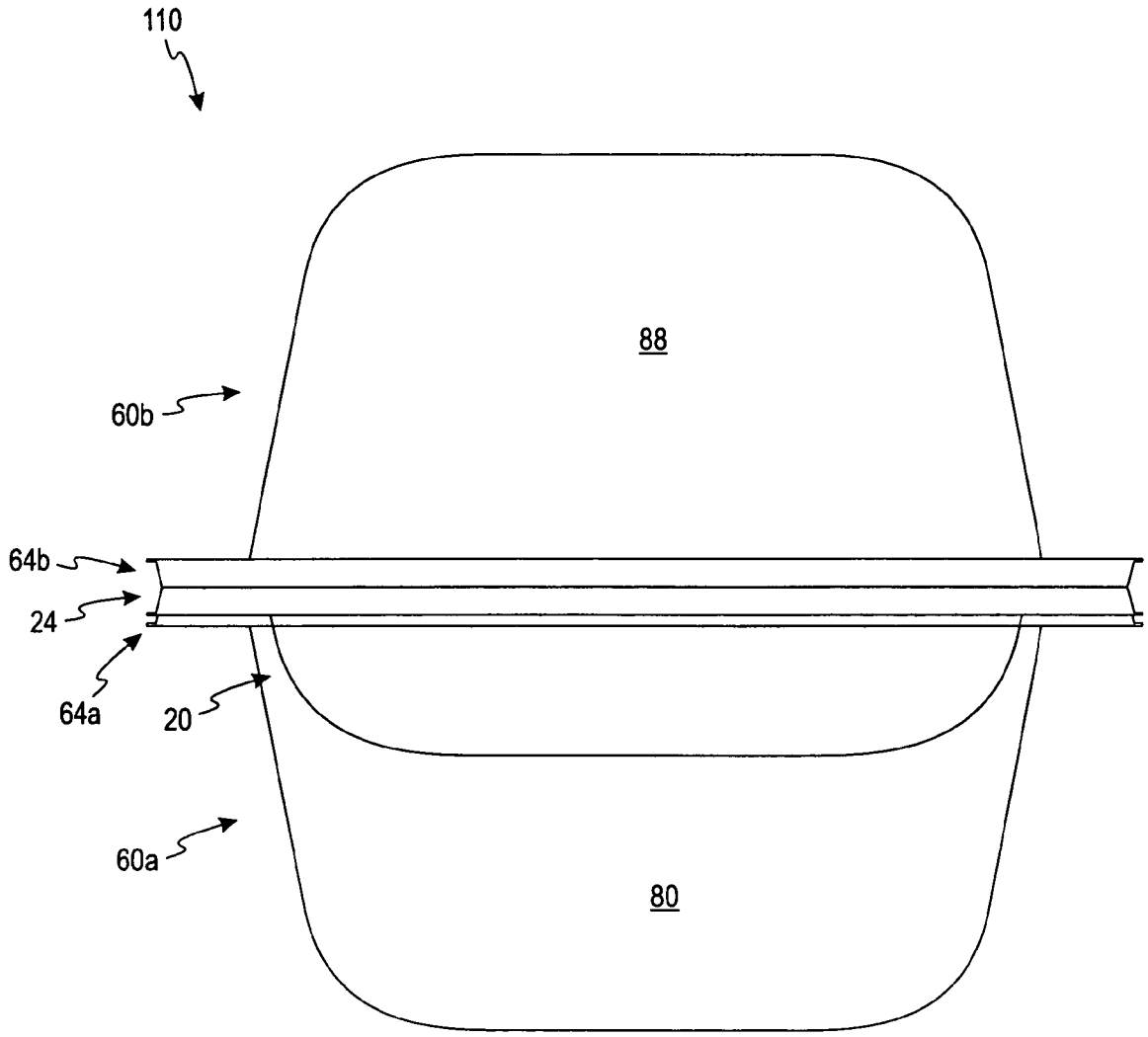
FIG. 6 is a side view of the plurality of containers of FIG. 5 in an assembled position.

It is contemplated that the modular container assembly may be formed with at least two containers being identical. For example, referring to FIGS. 5 and 6, a modular container assembly 110 includes the first container 20, a third container 60*a* and another third container 60*b*. FIG. 5 shows the modular container assembly 110 in an exploded view, while FIG. 6 shows the modular container assembly 110 in an assembled view with the rim 24, rim 64*a* and rim 64*b* being releasably engaged. The containers 60*a*, 60*b* are the same as the third container 60 discussed above. The first container 20 and the third container 60*a* form the area 80, which is the same as shown in the area 80 of FIGS. 2*a*, 2*b*. The first container 20 and the third container 60*b* form an area 88. The area 88 of FIG. 6 is larger than the area 82 formed by the first and the second containers 20, 40 of FIGS. 2*a*, 2*b*. The modular container assembly 110 functions in a similar manner as the modular container assembly 10.

Figure 7:
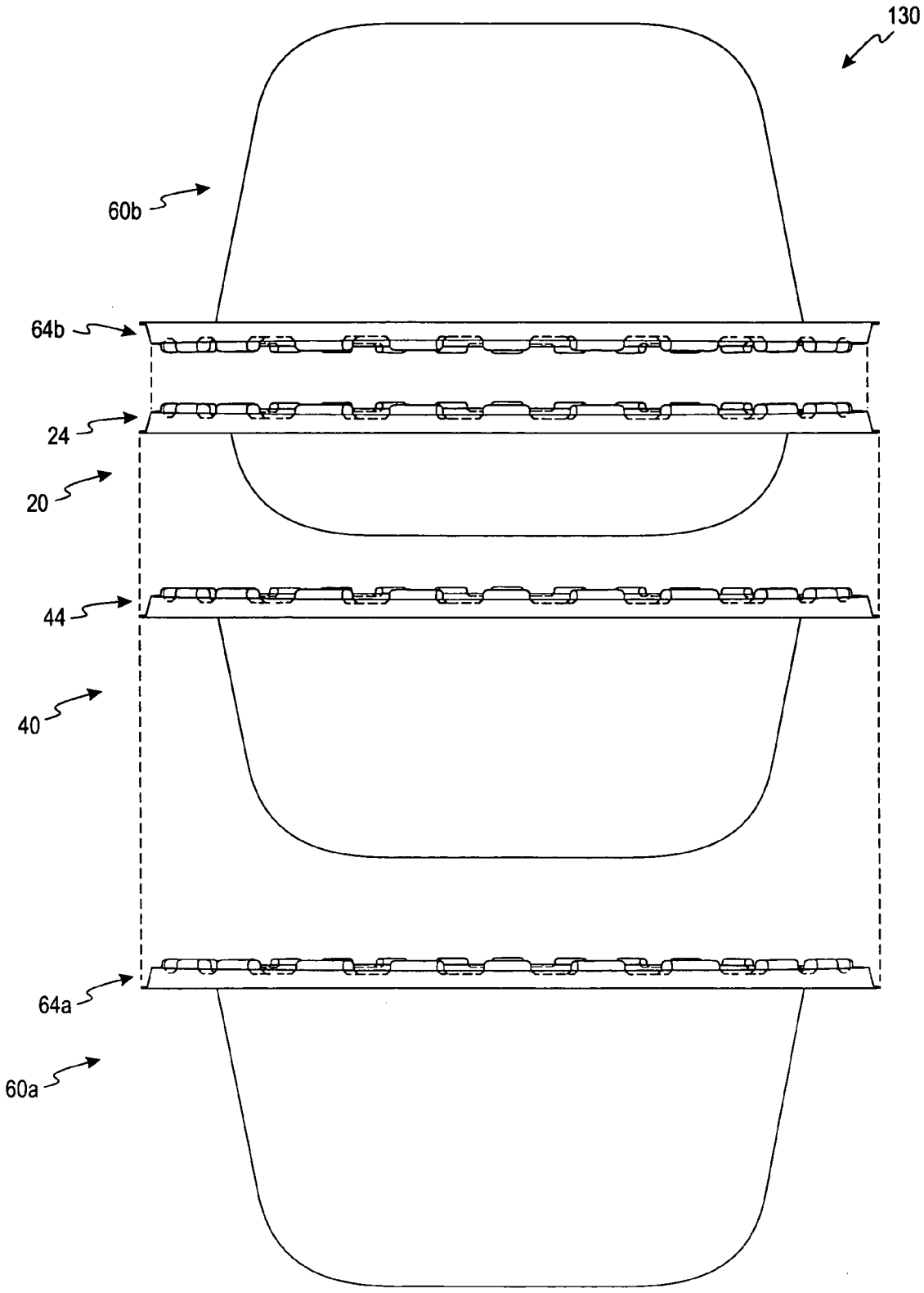
FIG. 7 is an exploded side view of a plurality of containers to be used in forming a modular container assembly according to a further embodiment of the invention.
Figure 8A:
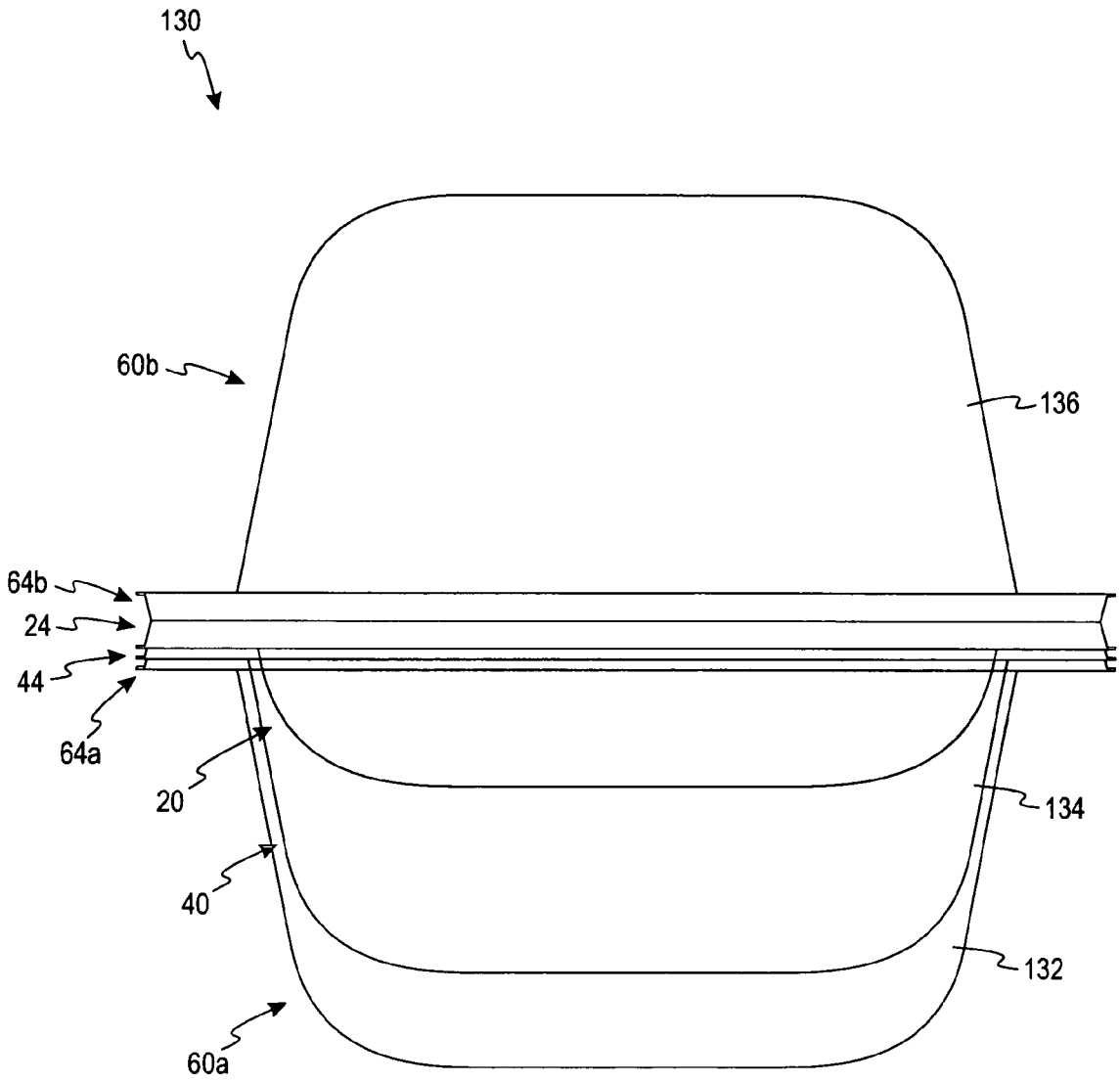
FIG. 8*a* is a side view of the plurality of containers of FIG. 7 in an assembled position.

It is also contemplated that a modular container assembly may be formed with more than three containers. For example, referring to FIGS. 7 and 8, a modular container assembly 130 includes the first container 20, the second container 40, the third container 60*a* and another third container 60*b*. FIG. 7 shows the modular container assembly 130 in an exploded view, while FIG. 8*a* shows the modular container assembly 130 in an assembled view with the rim 24, the rim 44, the rim 64*a* and the rim 64*b* being releasably engaged. In this embodiment, one of the containers (third container 60*b*) is inverted with respect the remaining containers (first container 20, second container 40 and the third container 60*a*). Also, in this embodiment, the containers forming the modular container assembly have at least three different shapes.

Figure 8B:
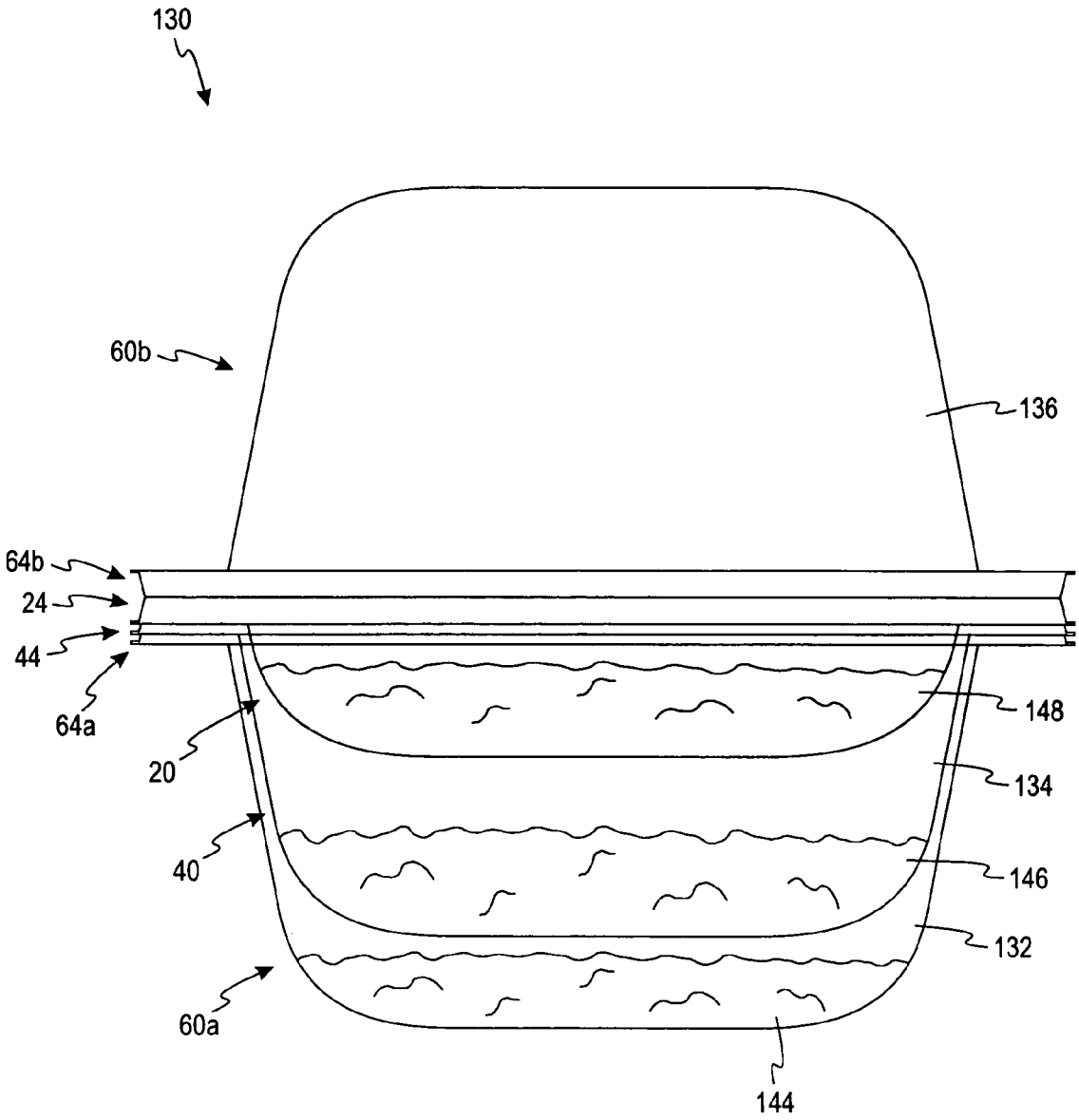
FIG. 8*b* is a side view of the plurality of containers of FIG. 7 in an assembled position with a first item, a second item and a third item.

The modular container assembly 130 of FIGS. 8*a*, 8*b* contains a first area 132, a second area 134 and a third area 136.

The first area 132 is formed between the third container 60*a* and the second container 40 and contains a first item 144 therein. The second area 134 is formed between the second container 40 and the first container 20 and contains a second item 146 therein. The third area 136 is formed between the first container 20 and the third container 60*b* and contains a third item 148 therein. The items 144, 146 and 148 may be food items or non-food items. The items 144, 146 and 148 may be the same or may be different. The modular container assembly 130 functions in a similar manner as the modular container assembly 10 except that different areas 132, 134 and 136 are formed.

Figure 9:
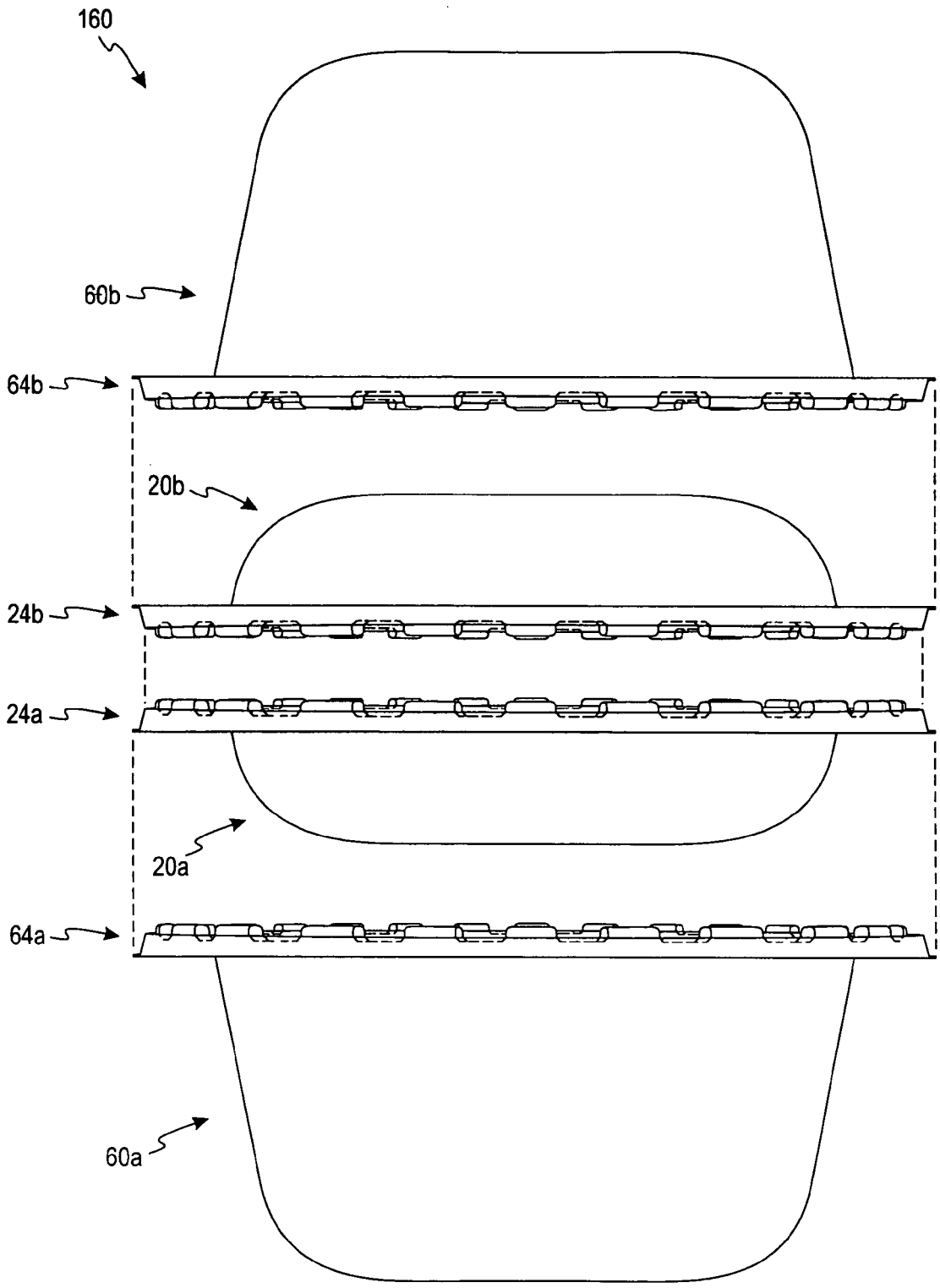
FIG. 9 is an exploded side view of a plurality of containers to be used in forming a modular container assembly according to yet another embodiment of the invention.
Figure 10:
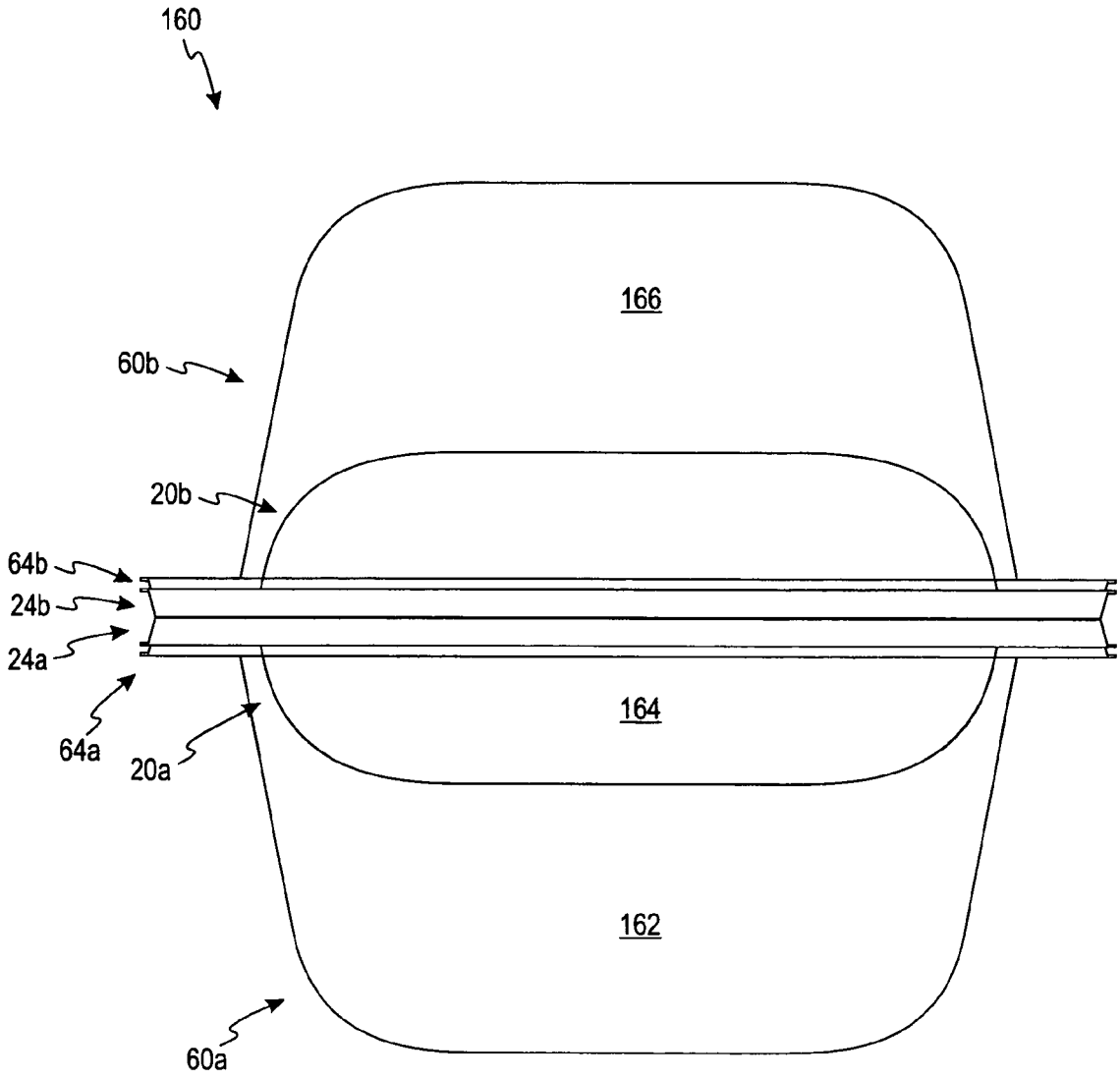
FIG. 10 is a side view of the plurality of containers of FIG. 9 in an assembled position.

Referring to FIGS. 9 and 10, a modular container assembly 160 contains a first container 20*a*, another first container 20*b*, the third container 60*a* and another third container 60*b*. The first containers 20*a*, 20*b* are identical to the first container 20. FIG. 9 shows the modular container assembly 160 in an exploded view, while FIG. 10 shows the modular container assembly 160 in an assembled view with rim 24*a*, rim 24*b*, the rim 64*a* and the rim 64*b* being releasably engaged. In this embodiment, two of the containers (first container 20*b* and the third container 60*b*) are inverted with respect to the remaining containers (first container 20*a* and the third container 60*a*).

The modular container assembly 160 of FIG. 10 contains a first area 162, a second area 164 and a third area 166. The area 162 is formed between the third container 60*a* and the first container 20*a*. The area 164 is formed between the first container 20*a* and the first container 20*b*. The area 166 is formed between the first container 20*b* and the third container 60*b*. The modular container assembly 160 functions in a similar manner as the modular container assembly 10 except that different areas 162, 164 and 166 are formed. It is contemplated that the modular container assembly may be formed with a first container, a second container, a third container and a fourth container being of different shapes.

Figure 11A:
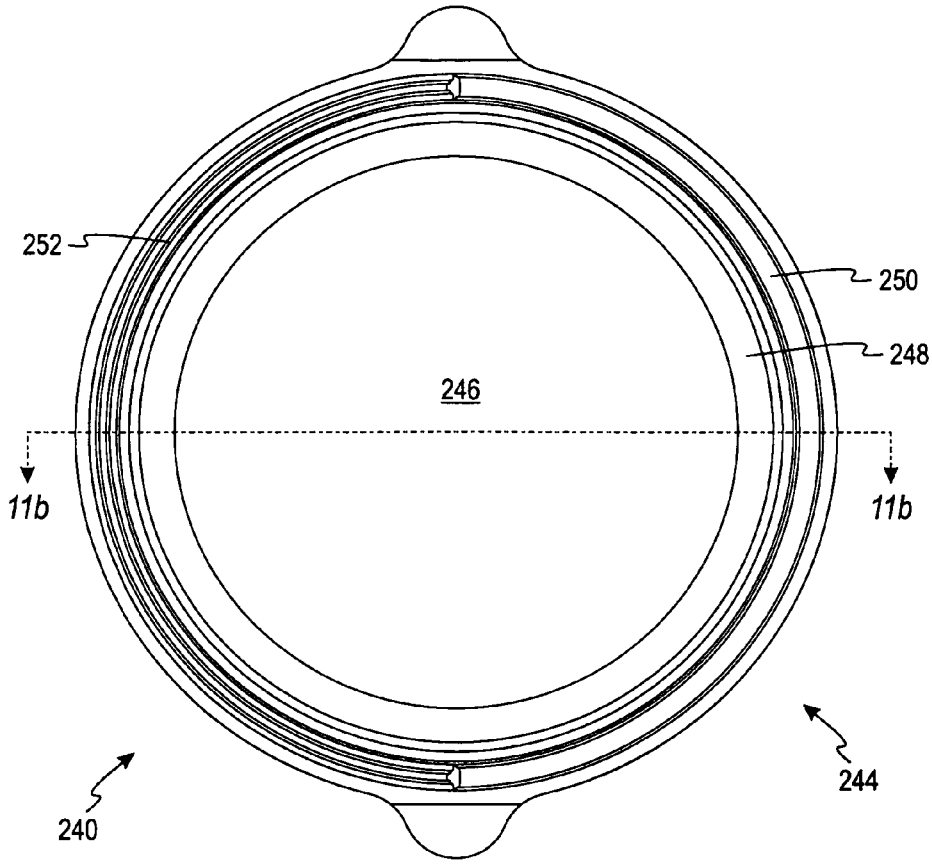
FIG. 11*a* is a top view of a container having a rib and groove to be used in a modular container assembly according to one embodiment.
Figure 11B:
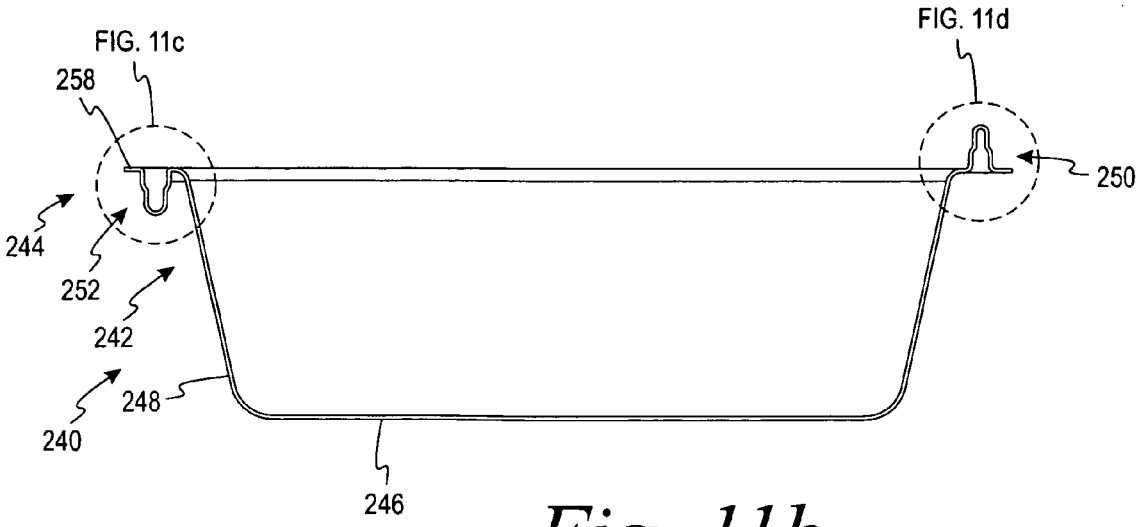
FIG. 11*b* is a side view of the container of FIG. 11*a*.

Referring to FIGS. 12-15, a modular container assembly 210 is shown according to another embodiment. The modular container assembly 210 includes a first container 220, a second container 240 and a third container 260. FIG. 12*a* depicts the modular container assembly 210 in an assembled position. Referring to FIGS. 11*a*, 11*b*, the second container 240 used in the modular container assembly 210 includes a continuous body portion 242 and a continuous rim 244 encompassing and projecting laterally outwardly from the body portion 242. The body portion 242 includes a bottom 246 and a continuous sidewall 248 encompassing and projecting upwardly and outwardly from the bottom 246. It is also contemplated that the rim may not be continuous, although it is preferred to be continuous.

The continuous rim 244 includes a feature (i.e., a rib 250) that projects generally upwardly therefrom and a second feature formed therein (i.e., groove 252). The rib 250 extends generally around about one-half of the circumference of the container 240 and the groove is formed around the remainder of the circumference of the container 240. It is contemplated that a container may include a plurality of ribs and a plurality of grooves.

Figure 11C:
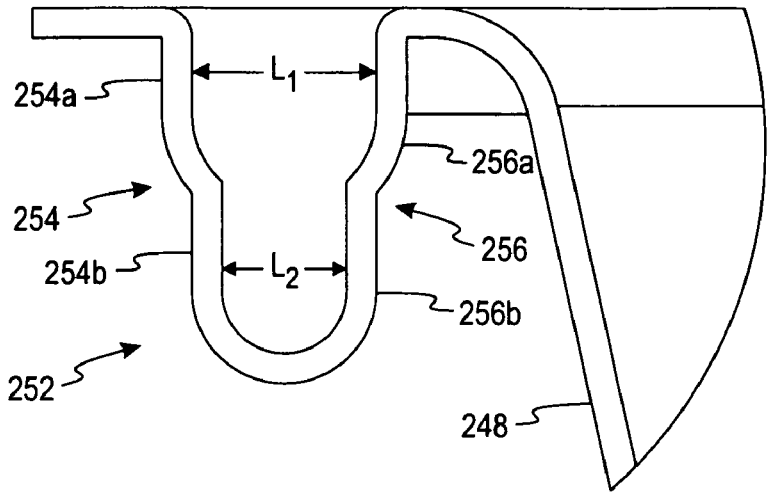
FIG. 11*c* is an enlarged view of generally circular region FIG. 11*c* of FIG. 11*b*.
Figure 11D:
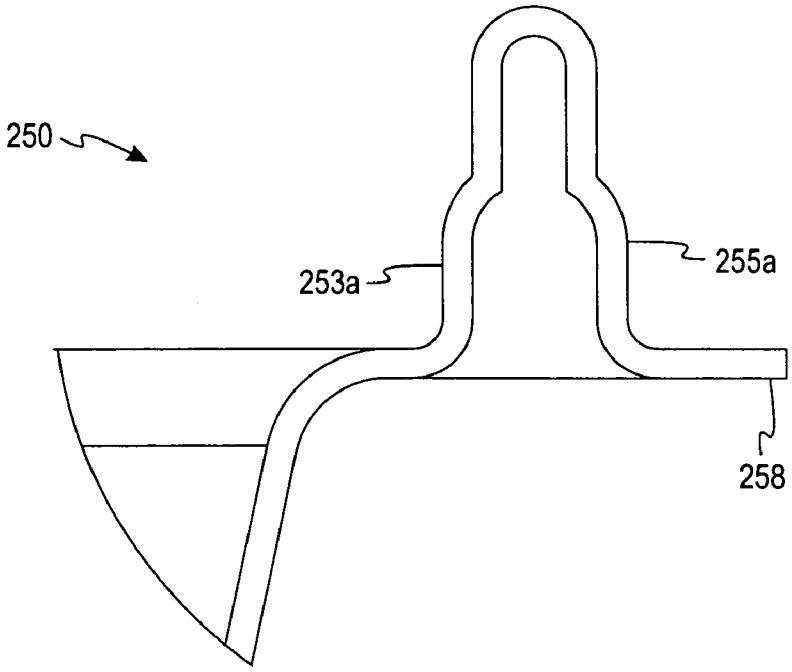
FIG. 11*d* is an enlarged view of generally circular region FIG. 11*d* of FIG. 11*b*.

The groove 252 as shown in FIG. 11*c* includes two sidewalls 254, 256. First sidewall 254 includes a first sidewall portion 254*a* and a second sidewall portion 254*b*. Similarly, second sidewall 256 includes a first sidewall portion 256*a* and a second sidewall portion 256*b*. The length L1 formed between the first sidewall portion 254*a* and the first sidewall portion 256*a* is greater in length than length L2 formed between the second sidewall portion 254*b* and the second sidewall portion 256*b*. As will be discussed in more detail below, having two different lengths L1, L2 assist in releasably engaging other containers in forming the modular container assembly.

Figure 13:
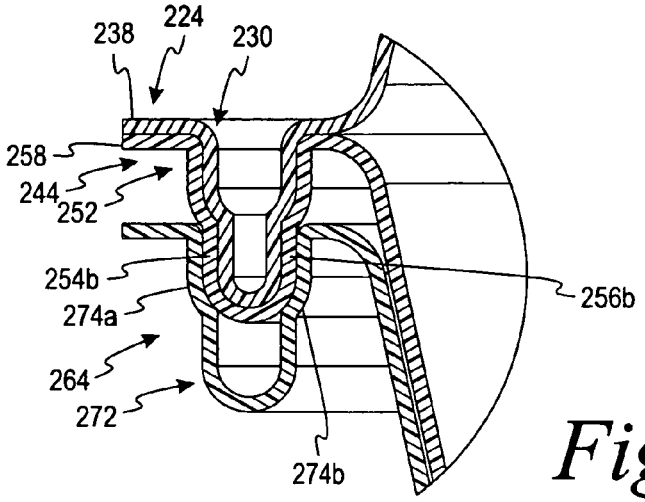
FIG. 13 is one enlarged side view of the rib and groove assembly of generally circular area FIG. 13 of FIG. 12*a*.
Figure 14:
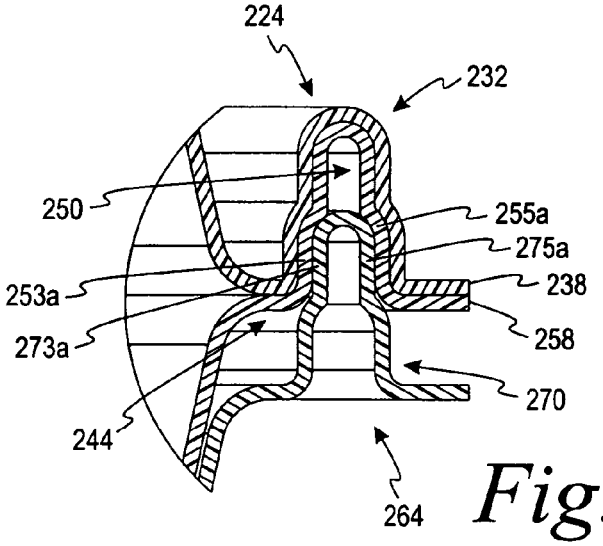
FIG. 14 is the other enlarged side view of the rib and groove assembly of generally circular area FIG. 14 of FIG. 12*a*.

Referring back to FIG. 11*b*, an optional seal feature 258 formed on the rim 244 is depicted and is located outwardly from the rib 250 and groove 252 with respect to the center of the second container 240. In other words, the optional seal feature 258 is located farther away from the center of the second container 240 than the rib 250 or groove 252. The optional seal feature 258 in conjunction with a corresponding optional seal feature 238 (as shown in FIGS. 13 and 14), along with the releasably engaged ribs and/or grooves of the modular container assembly, assists in preventing or inhibiting material from leaving or entering the modular container assembly. The optional seal feature is especially useful in preventing or inhibiting product leakage that may occur due to tolerances within the manufacturing process.

Figure 12A:
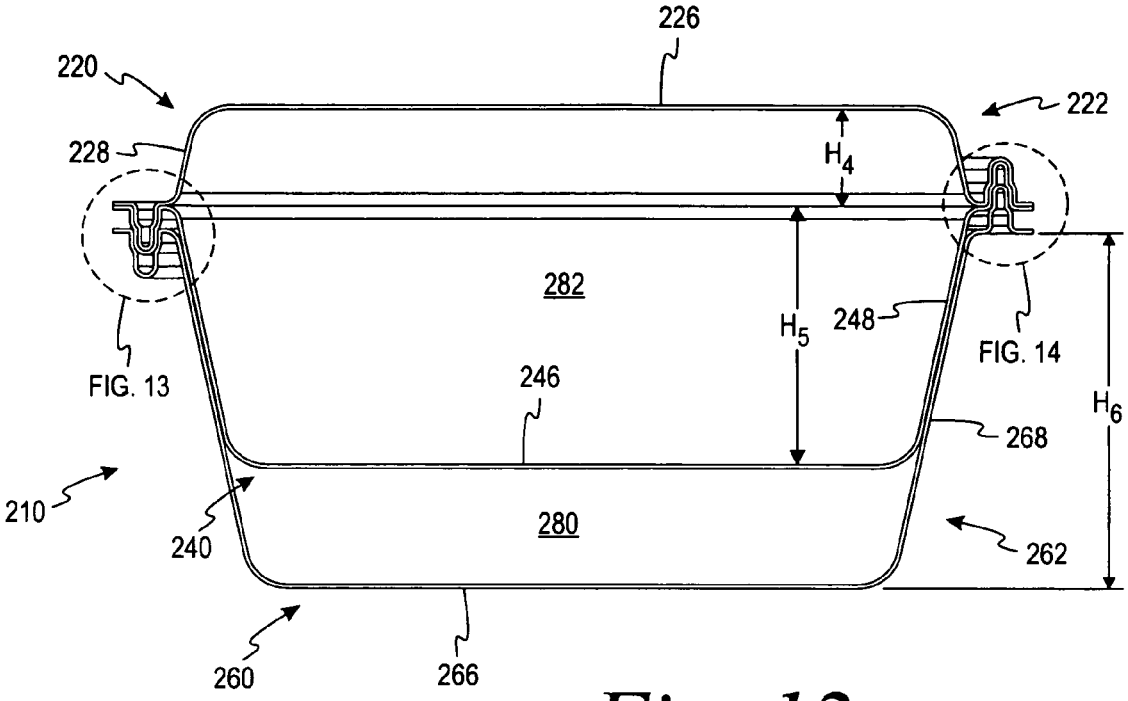
FIG. 12*a* is a side view of a modular container assembly using the container of FIGS. 11*a,b* and two other containers with a rib and groove.

In addition to the second container 240, the modular container assembly 210 of FIG. 12*a* includes the first container 220 and the third container 260. The first container 220 includes a continuous body portion 222 and a continuous rim 224 (see FIG. 13) encompassing and projecting laterally outwardly from the body portion 222. The body portion 222 includes a bottom 226 and a continuous sidewall 228 encompassing and projecting upwardly and outwardly from the bottom 226. The continuous rim 224 includes a feature (i.e., rib 230) that projects generally upwardly therefrom and a feature (i.e., groove 232). The rib 230 and the groove 232 are the same as described above with respect to the rib 250 and the groove 252.

The third container 260 includes a continuous body portion 262 and a continuous rim 264 (see FIG. 14) encompassing and projecting laterally outwardly from the body portion 262. The body portion 262 includes a bottom 266 and a continuous sidewall 268 encompassing and projecting upwardly and outwardly from the bottom 266. The continuous rim 264 includes a feature (i.e., rib 270) that projects generally upwardly therefrom and a feature (i.e., groove 272). The rib 270 and the groove 272 are the same as described above with respect to the rib 250 and the groove 252.

The containers 220, 240 and 260 of the modular container assembly 210 are of different shapes. Specifically, the height H4 of sidewall 228, the height H5 of sidewall 248 and the height H6 of sidewall 268 are of different lengths. The rims 224, 244 and 264 of respective containers 220, 240 and 260 are identical. It is contemplated that the rims may be substantially identical. The containers that form the modular container assembly 210 are depicted as being generally circular.

The height and shape of the modular container assembly may vary from that shown without departing from the scope of the invention. It is contemplated that the containers used to form the modular container assembly herein may be other shapes such as rectangular, square, hexagonal, octagonal, other polygonal shapes, oval or other non-polygonal shapes.

Figure 12B:
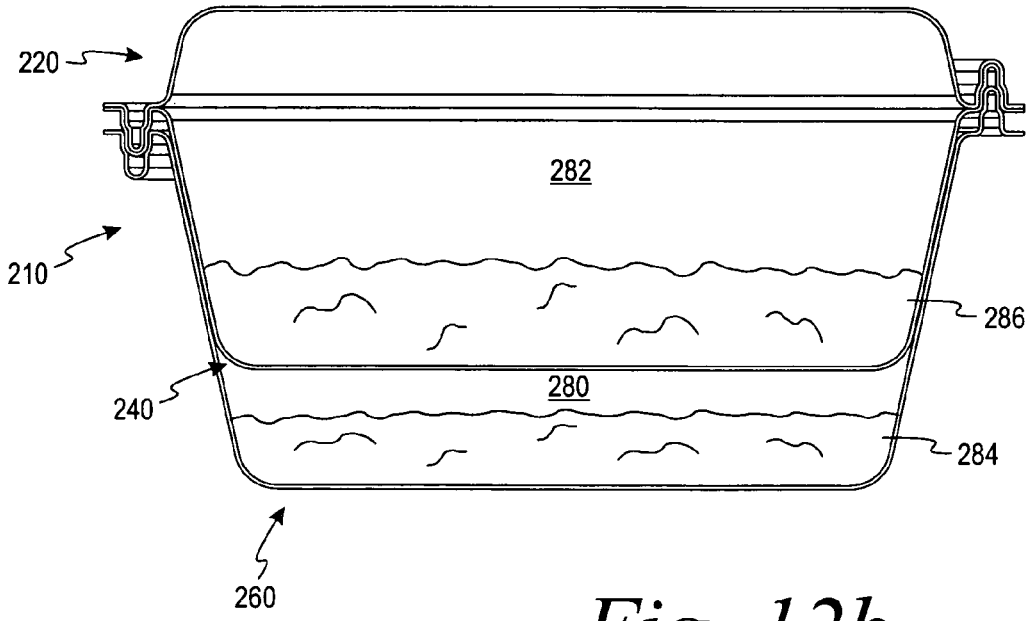
FIG. 12*b* is a side view of the modular container assembly of FIG. 12*a* with a first item and a second item.

As specifically shown in FIGS. 12*a*, 12*b*, the first container 220 is inverted with respect to the containers 240, 260. The interaction between the ribs and grooves is shown in more detail in FIGS. 13 and 14. As shown in FIG. 13, the groove 272 of the third container 260 releasably engages the groove 252 of the second container 240. Specifically, the second sidewall portions 254*b*, 256*b* of the groove 252 fit within first sidewall portions 274*a*, 274*b* of the groove 272. Referring still to FIG. 13, the groove 252 releasably engages the rib 230 of the first container 220. As shown in FIG. 13, the rib 230 extends into the entire interior of the groove 252. It is contemplated that a rib may extend into substantially the entire interior of the groove.

As shown in FIG. 14, the rib 250 of the second container 240 releasably engages the rib 270 of the third container 260. Specifically, second sidewall portions 273*a*, 275*a* of the rib 270 fit within first sidewall portions 253*a*, 255*a* of the rib 250. Referring still to FIG. 14, the groove 232 of the first container 220 releasably engages the rib 250 of the second container 240. The rib 250 extends into the entire interior of the groove 232. It is contemplated that a rib may extend into substantially the entire interior of the groove.

Figure 15:
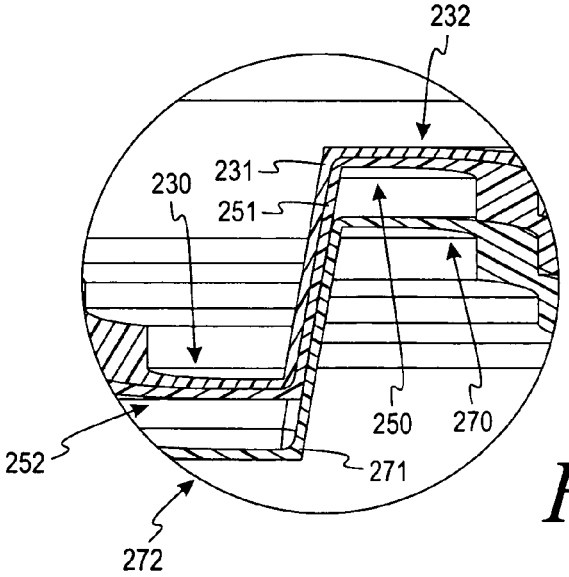
FIG. 15 is an enlarged side view of the transition region between the rib and groove of FIG. 12*a* in an assembled position.

The transition of the rib and the groove in the modular container assembly is shown in detail in FIG. 15. Specifically, in the third container 260, a transition 271 is formed between the rib 270 and the groove 272. In the second container 240, a transition 251 is formed between the rib 250 and the groove 252. In the first container 220, a transition 231 is formed between the rib 230 and the groove 232. Each of the transitions 231, 251 and 271 is substantially vertical. It is contemplated that the slope of the transition may vary from that shown in FIG. 15. The slope of the transition between the rib and groove generally ranges from about 2 to about 20 degrees and, more specifically, from about 5 to about 15 degrees as measured from a horizontal plane. The slope of the transition is dependent on the material thickness and the stack height between adjacent containers. It is desirable to optimize the slope of the transition to obtain a seal between the containers at this region.

Referring back to FIGS. 12*a* and 12*b* after the modular container assembly 210 is formed into an assembled position, a first area 280 is formed between the second container 240 and the third container 260, and a second area 282 is formed between the first container 220 and the second container 240. The first area 280 and the second area 282 are distinct from each other. In one embodiment shown in FIG. 12*b*, the first area 280 and the second area 282 contain respective first item 284 and second item 286. The first and second items may be food or non-food items. The first and second food items may be the same or may be different. The first and/or second food items may be a liquid. It is contemplated that other foods may be stored in the modular container assembly 210.

To form the modular container assembly 210, the first container 220, the second container 240 and the third container 260 are provided. The second container 240 and the third container 260 are aligned such that the second rim 244 and the third rim 264 are adjacent to each other. The upwardly-projecting feature (i.e., rib 270) of the third container 260 is fit into the upwardly-projecting feature (i.e., rib 250) of the second container 240 and the groove 252 of the second container 240 is fit into the groove 272 of the third container 260 such that the second and the third containers 240, 260 are releasably engaged to each other and form the first area 280. To fit the rib 270 into the rib 250, the container 240 or the container 260 may have to be rotated slightly such that the ribs 250, 270 are aligned with each other.

The first container 220 is placed in an inverted position relative to the third container 260. For example, the first container 220 may be flipped 180 degrees relative to the third container 260. The first and second containers 220, 240 are aligned such that the rims 224, 244 are adjacent to each other. The upwardly-projecting feature (e.g., rib 230) of the first container 220 is fit into the groove 252 of the second container 240 and the rib 250 of the second container 240 is fit into the groove 232 of the first container 220 such that the first and the second containers 220, 240 are releasably engaged to each other and form the second area 282.

Figure 16A:
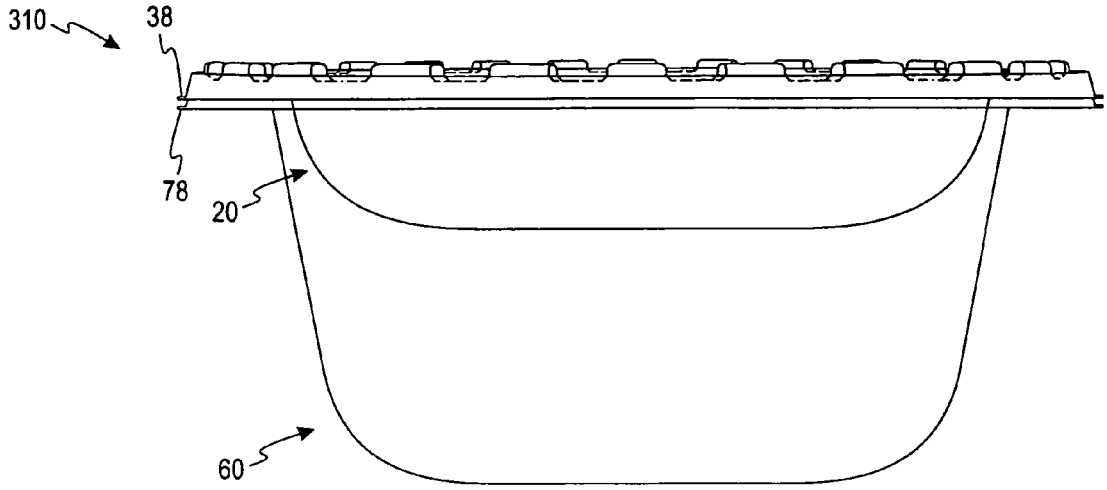
FIG. 16*a* is a side view of a modular container assembly in an assembled position according to another embodiment.

Another embodiment of the modular container assembly is depicted in FIG. 16*a*. A modular container assembly 310 of FIG. 16*a* includes the first container 20 and the third container 60 that were discussed above in connection with FIGS. 1 and 2. The first container 20 and the third container 60 are releasably engageable to each other. The first container 20 includes the seal feature 38 and the third container 60 includes a seal feature 78. The seal features 38, 78 are in sealingly engagement to each other.

Figure 16B:
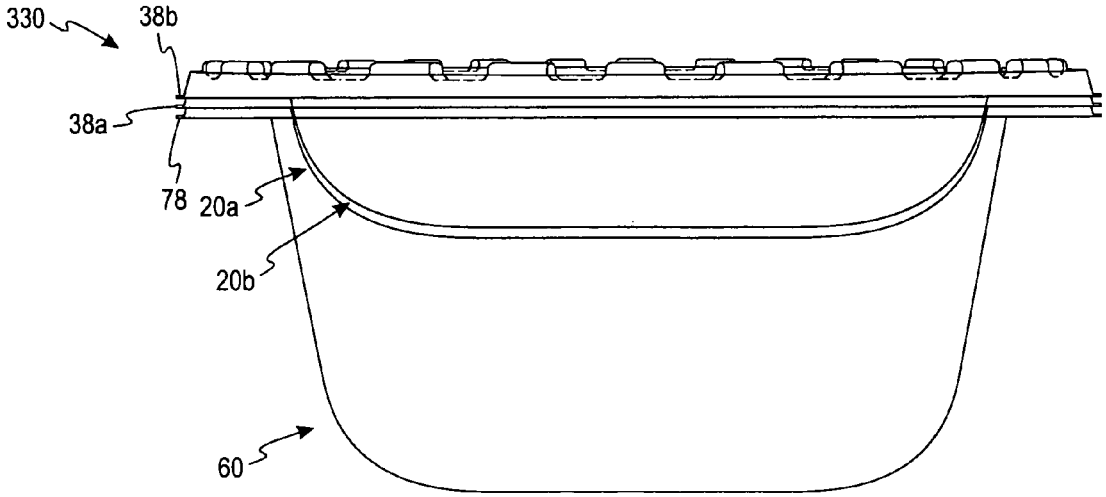
FIG. 16*b* is a side view of a modular container assembly in an assembled position according to yet another embodiment.

It is contemplated that a modular container assembly may include a plurality of first containers. For example, referring to FIG. 16*b*, a modular container assembly 330 includes a plurality of first containers 20*a*, 20*b*. The plurality of first containers 20*a*, 20*b* may be plates. Such an embodiment is desirable if the modular container assembly 330 contains a food item that is to be served to a number of people on plates. It is contemplated that a modular container assembly may include additional first containers.

Figure 17A:
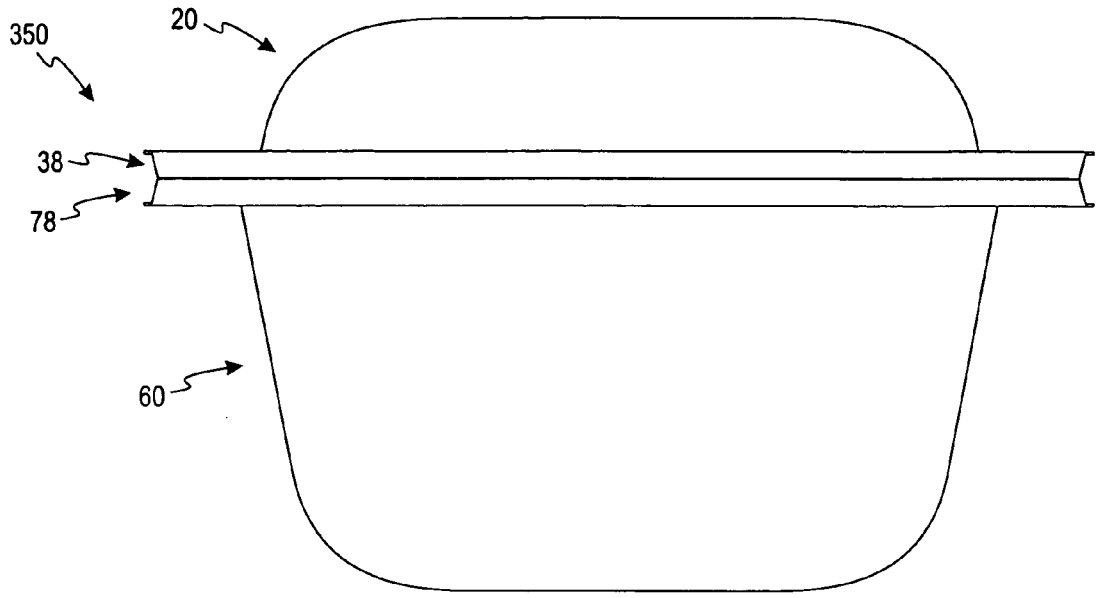
FIG. 17*a* is a side view of a modular container assembly in an assembled position according to a further embodiment.

A further embodiment of a modular container assembly is depicted in FIG. 17*a*. A modular container assembly 350 of FIG. 17*a* includes the first container 20 and the third container 60. The first container 20 is inverted with respect to the third container 60. The first container 20 and the third container 60 are releasably engageable to each other. The first container 20 includes the seal feature 38 and the third container 60 includes the seal feature 78. The seal features 38, 78 are in sealingly engagement to each other.

Figure 17B:
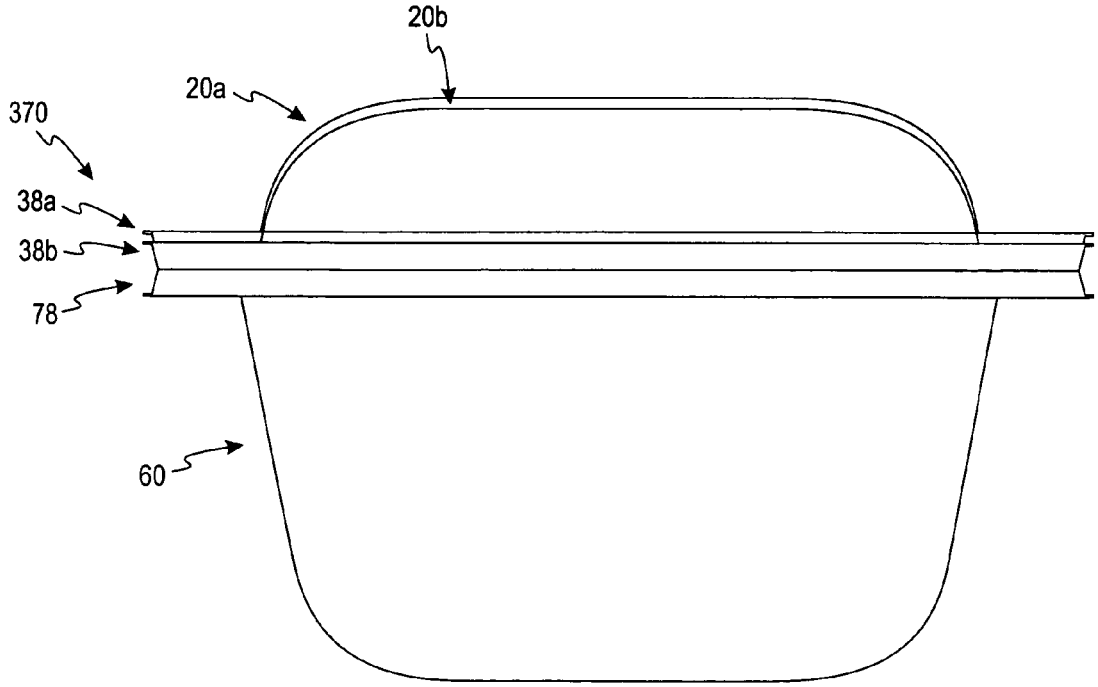
FIG. 17*b* is a side view of a modular container assembly in an assembled position according to a further embodiment.

It is contemplated that a modular container assembly may include a plurality of first containers. For example, referring to FIG. 17*b*, a modular container assembly 370 includes a plurality of first containers 20*a*, 20*b* and the third container 60. The plurality of first containers 20*a*, 20*b* may be plates. The first containers 20*a*, 20*b* includes respective seal features 38*a*, 38*b* and the third container 60 includes the seal feature 78. The seal features 38*a* and 78, and the seal features 38*a* and 38*b* are in sealingly engagement to each other. Such an embodiment is desirable if the modular container assembly 370 contains a food item that is to be served to a number of people on plates. It is contemplated that a modular container assembly may include additional first containers.

The containers used in forming the modular container assembly may be used in forming a merchandising container display. For example, referring to FIG. 18*a*, a merchandizing container 410 comprises a plurality of third containers 60*a-e*. The third containers 60*a-e* are the same as the container 60 discussed above. Each of the plurality of first containers is releasably engaged to another one of the plurality of first containers by fitting the first upwardly-projecting feature of a first container into the first upwardly-projecting feature of another first container. This method of merchandising saves space in store shelves, reduces the number of merchandizing displays needed on the shelves, and also reduces costs in transporting the items. Additionally, the stacking shows the functionality of the containers. It is contemplated that other containers such as containers 20, 40 of FIGS. 1-2 or containers 220, 240, 260 of FIGS. 11-15 may be used in a merchandising container display.

Figure 18A:
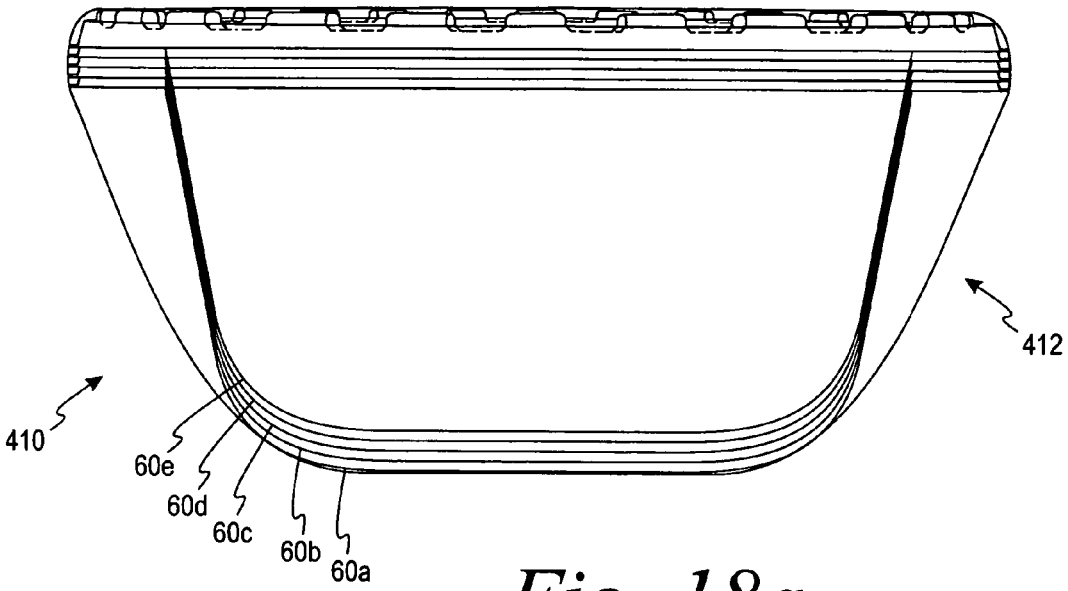
FIG. 18*a* is a merchandising container display with a plurality of containers in a shrink wrap according to one embodiment.

As shown in FIG. 18*a*, a shrink-wrap 412 may cover the plurality of containers 60*a-e*. The shrink-wrap may be made from a polymeric material. One type of polymeric materials that may be used in forming the shrink-wrap is polyvinyl chloride (PVC). The shrink wrap is desirably transparent or at least semi-transparent.

Figure 18B:
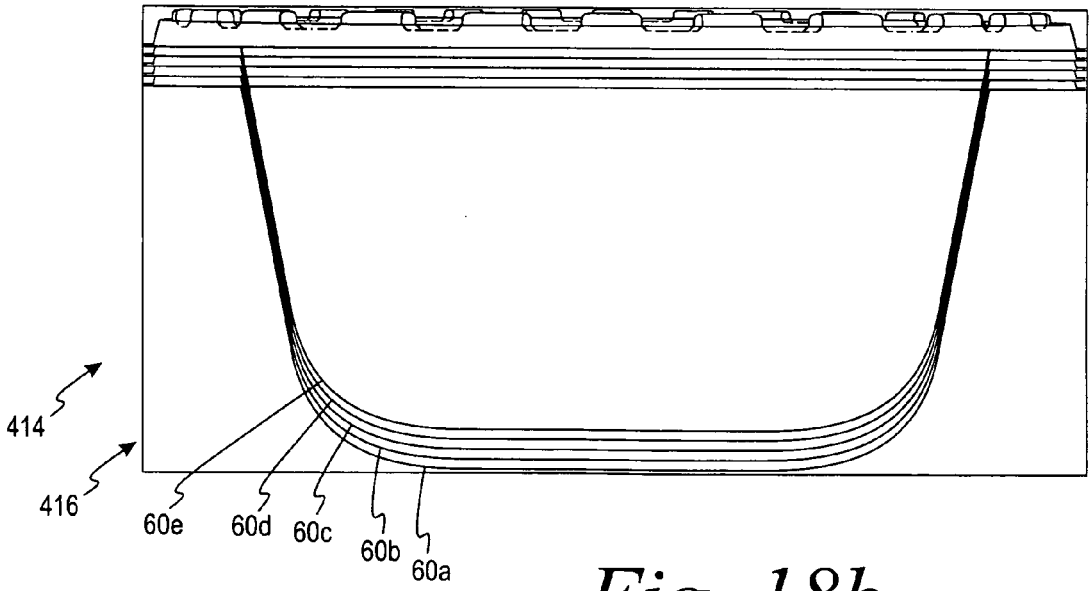
FIG. 18*b* is the merchandising container display of FIG. 18*a* in a protective sleeve.

As shown in FIG. 18*b*, the merchandizing container 414 includes the plurality of containers 60*a-e* contained within a base or sleeve 416. The sleeve may be made from a number of materials such as polymeric materials, paper materials such as paperboard or cardboard, metal or wire. It is contemplated that the embodiment of FIG. 18*b* may further include shrink wrap. It is contemplated that the modular container assembly may be self-contained. In other words, the display does not require an additional item (e.g., a rack) to hold and display the containers in a generally upright position.

Figure 19A:
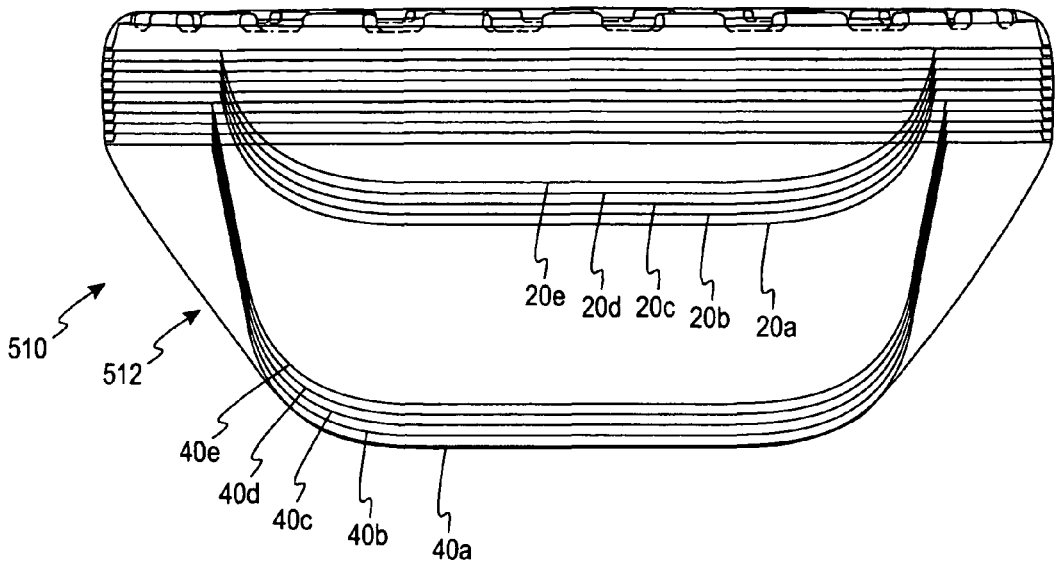
FIG. 19*a* is a merchandizing container display with a first plurality of containers and a second plurality of containers in a shrink wrap according to another embodiment.
Figure 19B:
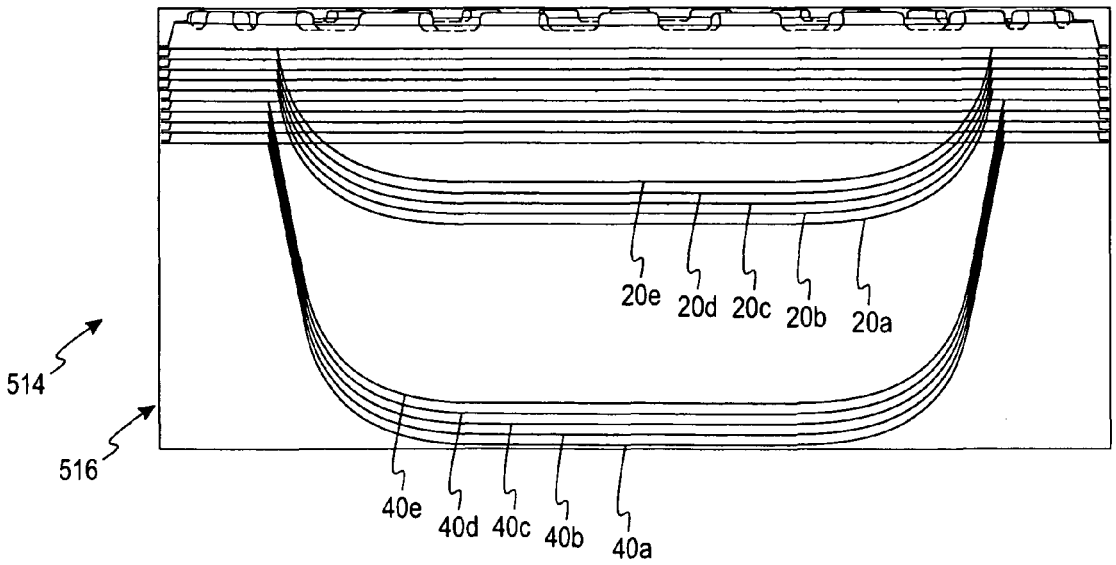
FIG. 19*b* is the merchandising container display of FIG. 19*a* in a protective sleeve.

It is contemplated that the merchandising container display may include containers of different shapes. One example of a display having two different shaped containers is depicted in FIGS. 19*a*, 19*b*. Specifically, a merchandising container display 510 of FIG. 19*a* depicts first containers 20*a-e* and second containers 40*a-e*. The second containers 40*a-e* are identical to the second container 40 described above. The first containers 20*a-e* are identical to the first container 20 described above. As shown in FIG. 19*a*, a shrink-wrap 512 covers the plurality of containers 20*a-e* and 40*a-e*. The shrink wrap 512 may be made of the same materials as the shrink wrap 412.

Referring to FIG. 19*b*, a merchandizing container 514 includes the first containers 20*a-e* and second containers 40*a-e* within a base of sleeve 516. The base or sleeve 516 may be made of the same materials as the sleeve 416.

Figure 20A:
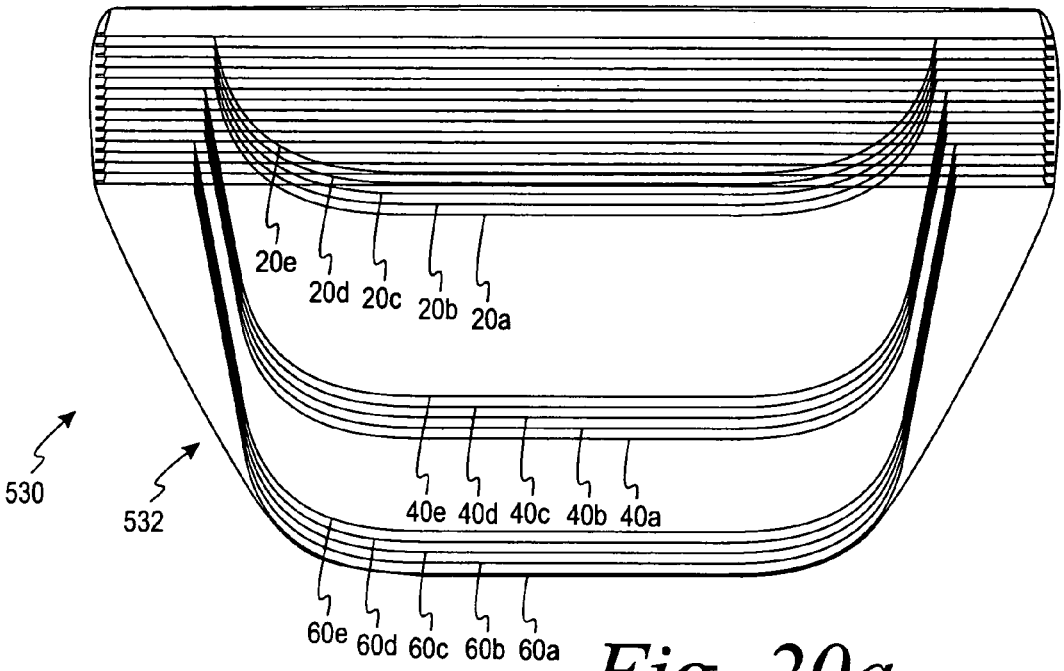
FIG. 20*a* is a merchandizing container display with a first plurality of containers, a second plurality of containers and a third plurality of containers in a shrink wrap according to a further embodiment.
Figure 20B:
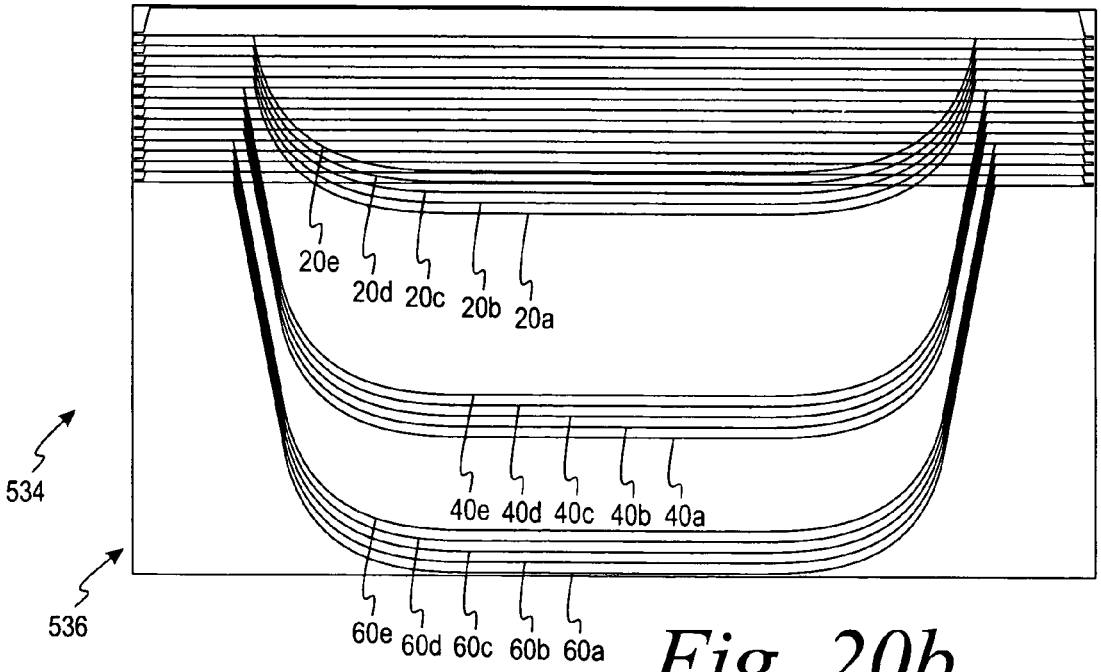
FIG. 20*b* is the merchandising container display of FIG. 20*a* in a protective sleeve.

Another example of a merchandizing container display with containers of different shapes is shown in FIGS. 20*a-b*. Specifically, a merchandizing container display 530 of FIG. 20*a* depicts first containers 20*a-e*, second containers 40*a-e* and third containers 60*a-e*. As shown in FIG. 20*a*, a shrink-wrap 532 covers the plurality of containers 20*a-e*, 40*a-e* and 60*a-e*. The shrink wrap 532 may be made of the same materials as the shrink wrap 412.

Referring to FIG. 20*b*, a merchandizing container 514 includes the first containers 20*a-e*, second containers 40*a-e* and third containers 60*a-e* within a base of sleeve 536. The base or sleeve 536 may be made of the same materials as the sleeve 416.

Figure 20C:
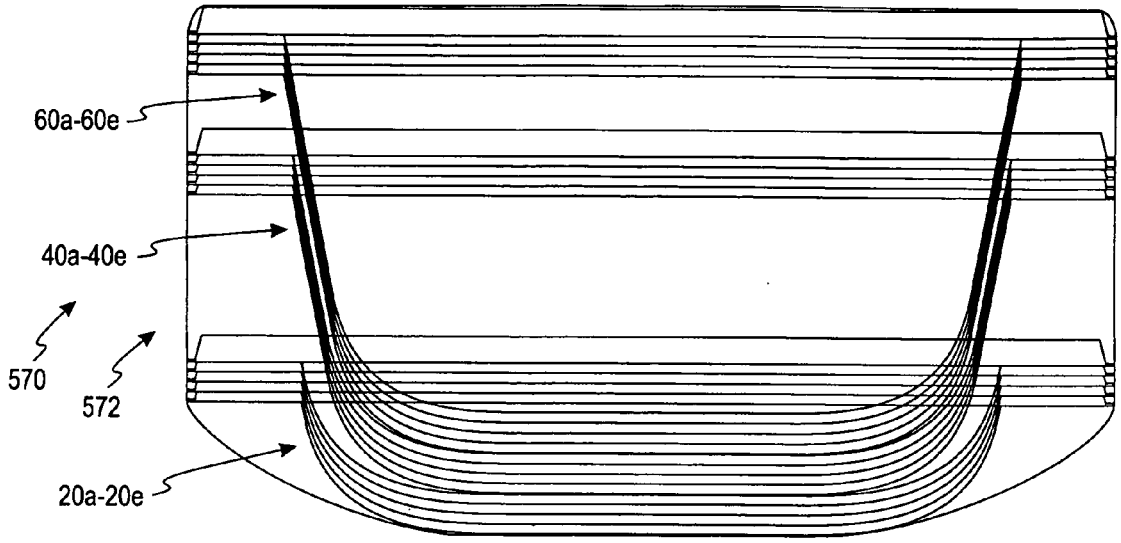
FIG. 20*c* is a merchandizing container display with the containers of FIG. 20*a* in a different order in a shrink wrap according to another embodiment.

Referring to FIG. 20*c*, a merchandizing container 570 includes first containers 20*a-e*, second containers 40*a-e* and third containers 60*a-e* in a different order from FIG. 20*a*. This order may be desirable because it shows the different sized containers within the merchandizing container. As shown in FIG. 20*c*, a shrink-wrap 572 covers the plurality of containers 20*a-e*, 40*a-e* and 60*a-e*. The shrink wrap 572 may be made of the same materials as the shrink wrap 412.

Figure 20D:
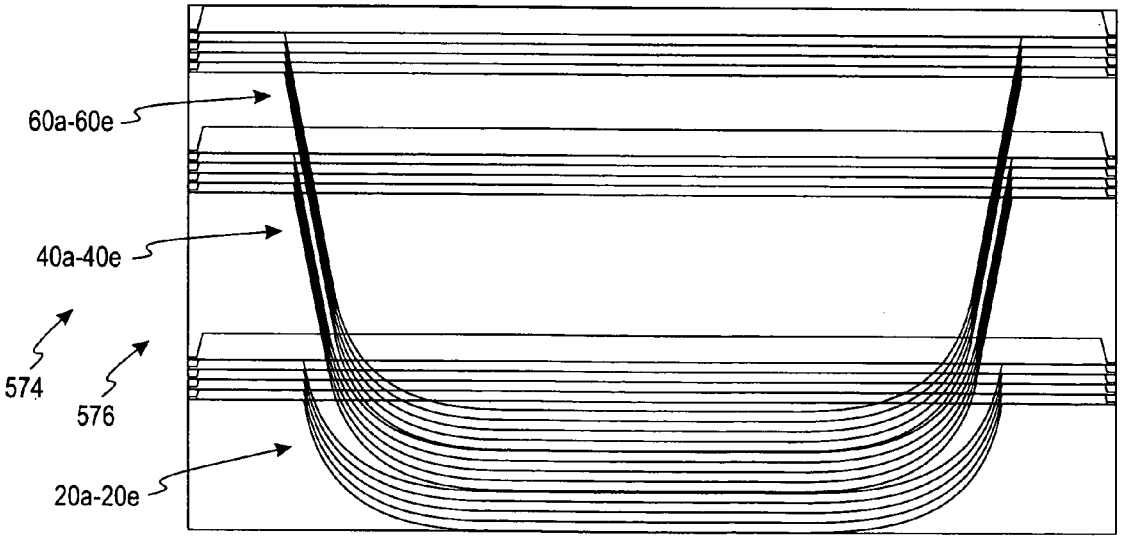
FIG. 20*d* is a merchandizing container display with the containers of FIG. 20*a* in a different order in a protective sleeve according to another embodiment.

Referring to FIG. 20*d*, a merchandizing container 574 includes the first containers 20*a-e*, second containers 40*a-e* and third containers 60*a-e* within a base of sleeve 576 in a different order from FIG. 20*b*. The base or sleeve 576 may be made of the same materials as the sleeve 416.

Figure 22A:
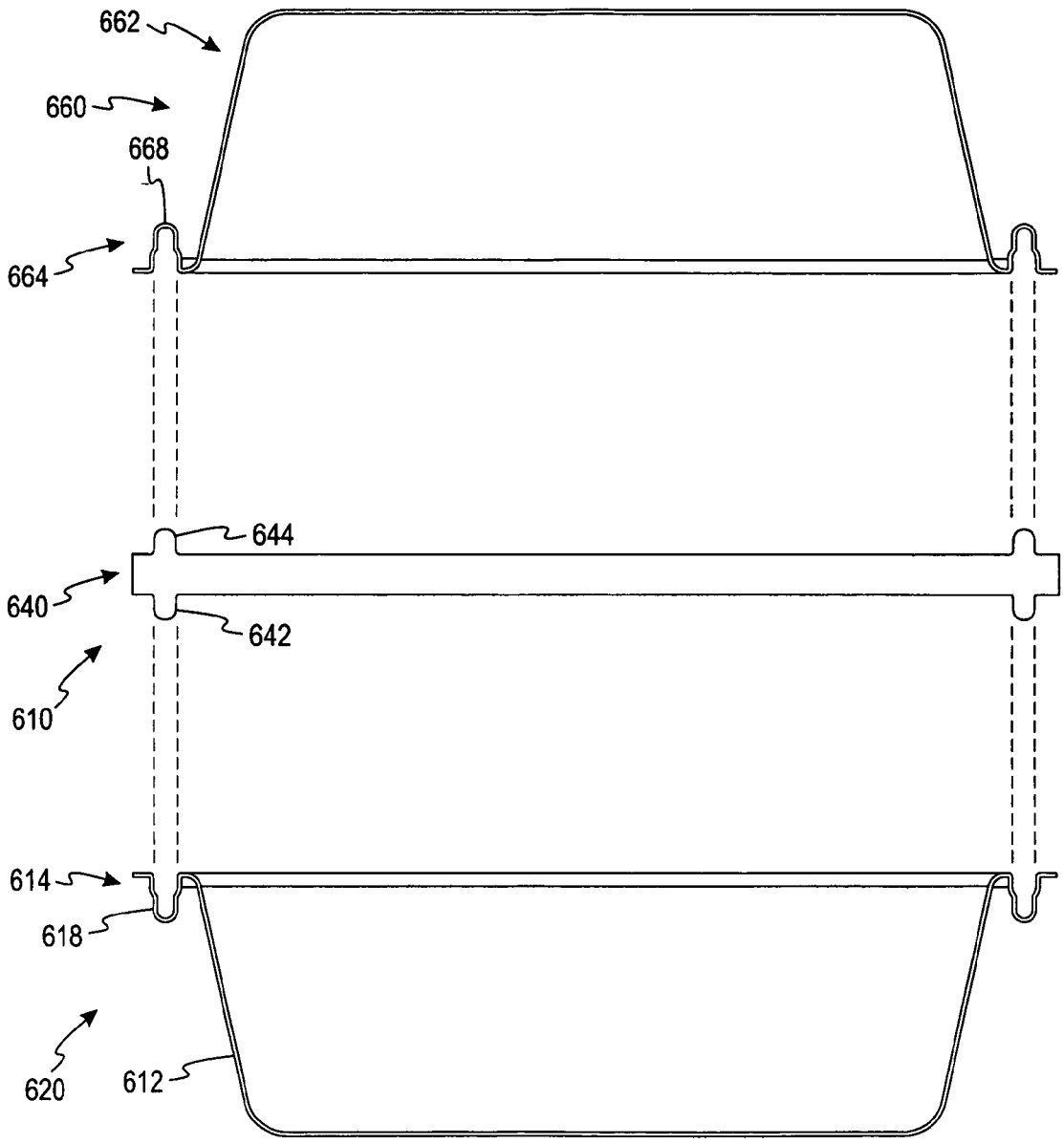
FIG. 22*a* is an exploded side view of a container assembly using a connecting member according to one embodiment.
Figure 22B:
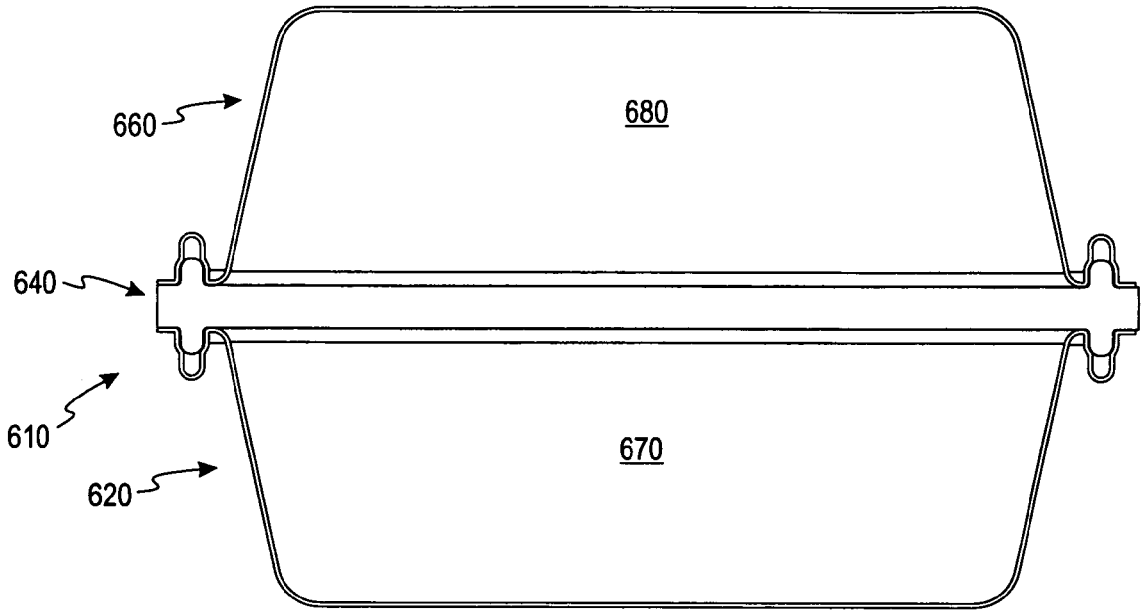
FIG. 22*b* is a side view of the container assembly of FIG. 22*a*.

Referring to FIGS. 22-24, a modular container assembly may include the use of a connecting member. Referring specifically to FIGS. 22*a*, 22*b*, a modular container assembly 610 includes a first container 620 and a second container 660. In this embodiment, the first container and the second container are identical. The first and second containers may be substantially identical. It is contemplated that the first and second containers may not be substantially identical or identical.

The first container 620 includes a continuous body portion 612 and a rim 614. The rim 614 encompasses and projects laterally outwardly from the body portion 612. The rim 614 has a first feature 618 (e.g., groove) formed therein. The second container 660 includes a continuous body portion 662 and a rim 664. The rim 664 encompasses and projects laterally outwardly from the body portion 662. The rim 664 has a first feature 668 (e.g., groove) formed therein.

The first container 620 is adapted to be releasably engageable with the second container 660 in an inverted position via a connecting member 640. Specifically, extension 642 of the connecting member 640 is fit into the groove 618 and extension 644 of the connecting member 640 is fit into the groove 668 to releasably engage the first container 620 to the second container 660. After the connecting member 640 releasably engages the first container 620 and the second container 660, the modular container assembly 610 is formed as shown in FIG. 22*b*. When the connecting member 640 is releasably engaged, a first area 670 is formed and a second area 680 is formed. The first and second areas 670, 680 are distinct from each other. In one embodiment, the first area contains a first item and the second area contains a second item, which may be the same or different from the first item. The items may be food items or non-food items.

Figure 23A:
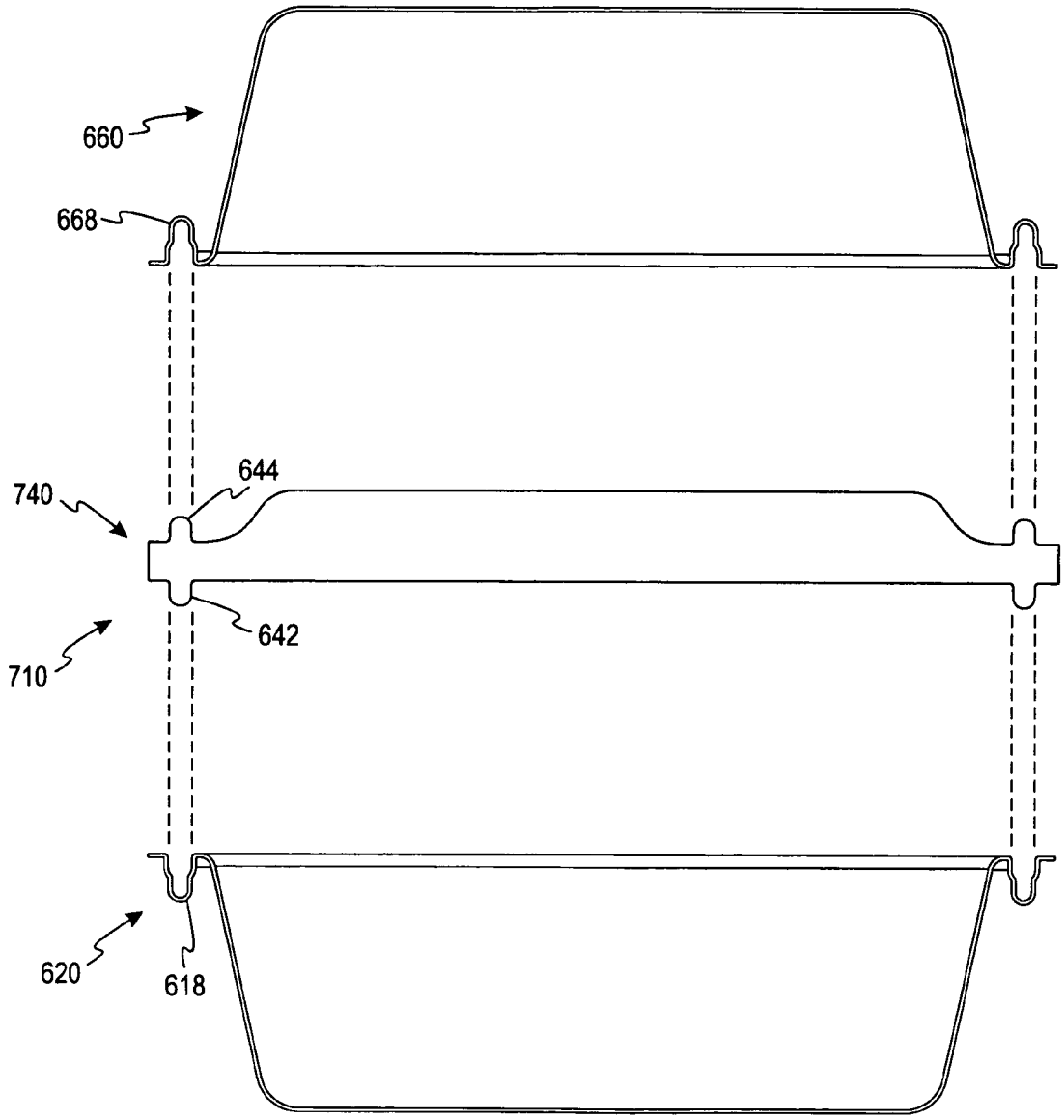
FIG. 23*a* is an exploded side view of a container assembly using a connecting member according to another embodiment.
Figure 23B:
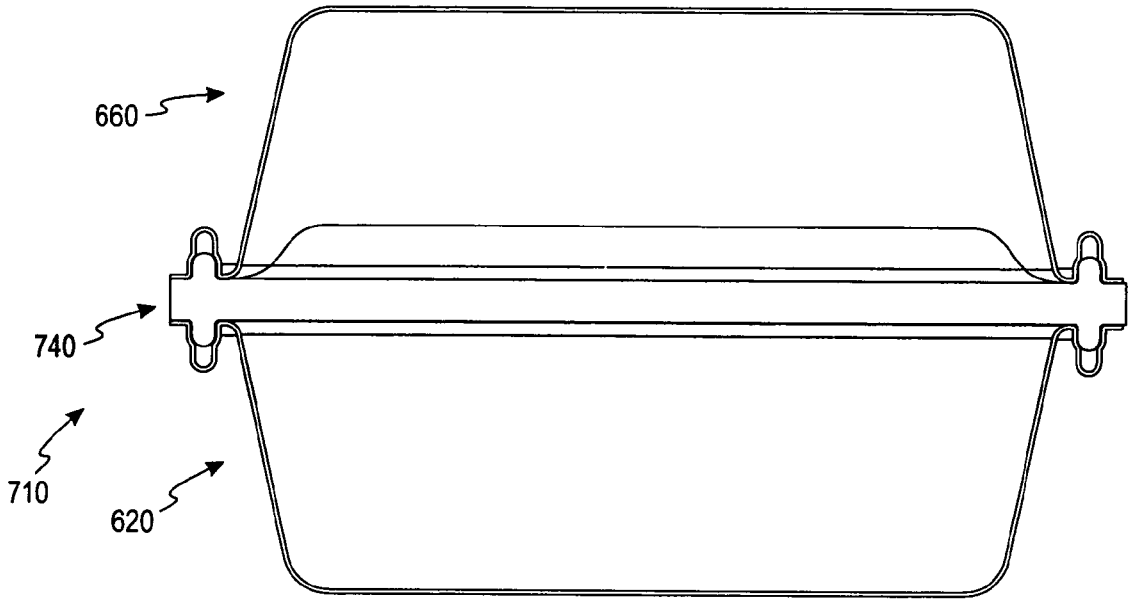
FIG. 23*b* is a side view of the container assembly of FIG. 23*a*.

Referring to FIGS. 23*a*, 23*b*, another modular container assembly 710 is shown. The modular container assembly 710 includes the first container 620, the second container 660 and a connecting member 740. The connecting member 740 is in the form of a container (e.g., a plate) and includes extensions 642, 644. The first container 620 is adapted to be releasably engageable with the second container 660 in an inverted position via the connecting member 840. Specifically, extension 642 of the connecting member 840 is fit into the groove 618 and extension 644 of the connecting member 740 is fit into the groove 668 to releasably engage the first container 620 to the second container 660. After the connecting member releasably engages the first container 620 and the second container 660, the modular container assembly 710 is formed as shown in FIG. 23*b*.

Figure 24A:
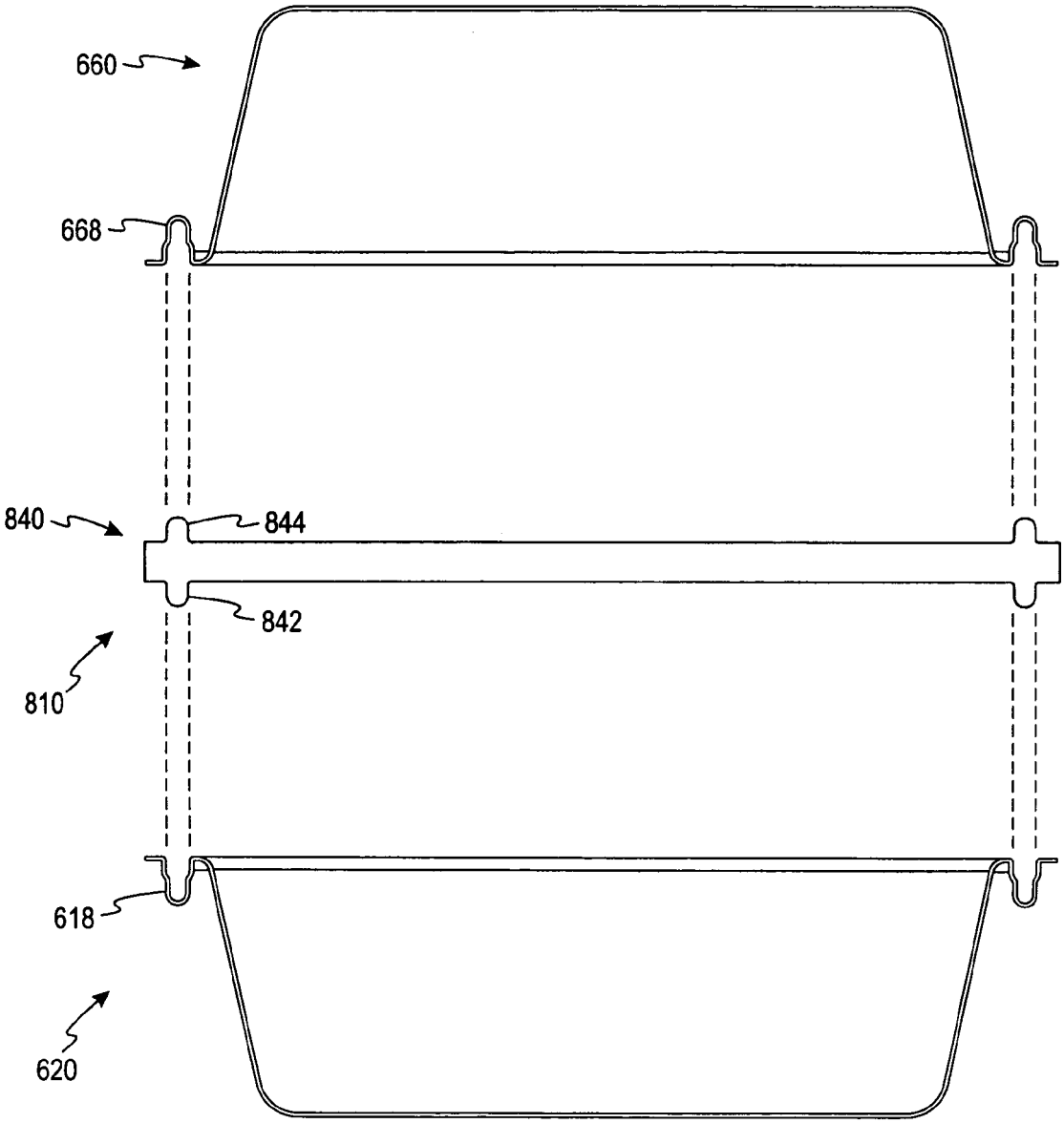
FIG. 24*a* is an exploded side view of a container assembly using a connecting member according to a further embodiment.
Figure 24B:
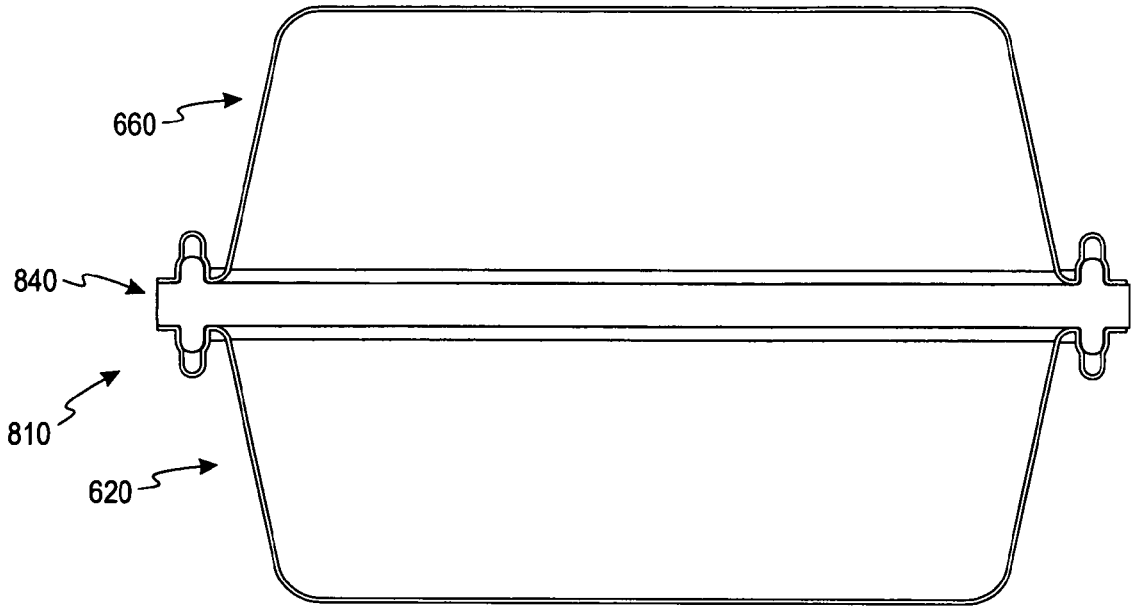
FIG. 24*b* is a side view of the container assembly of FIG. 24*a*.
Figure 24C:
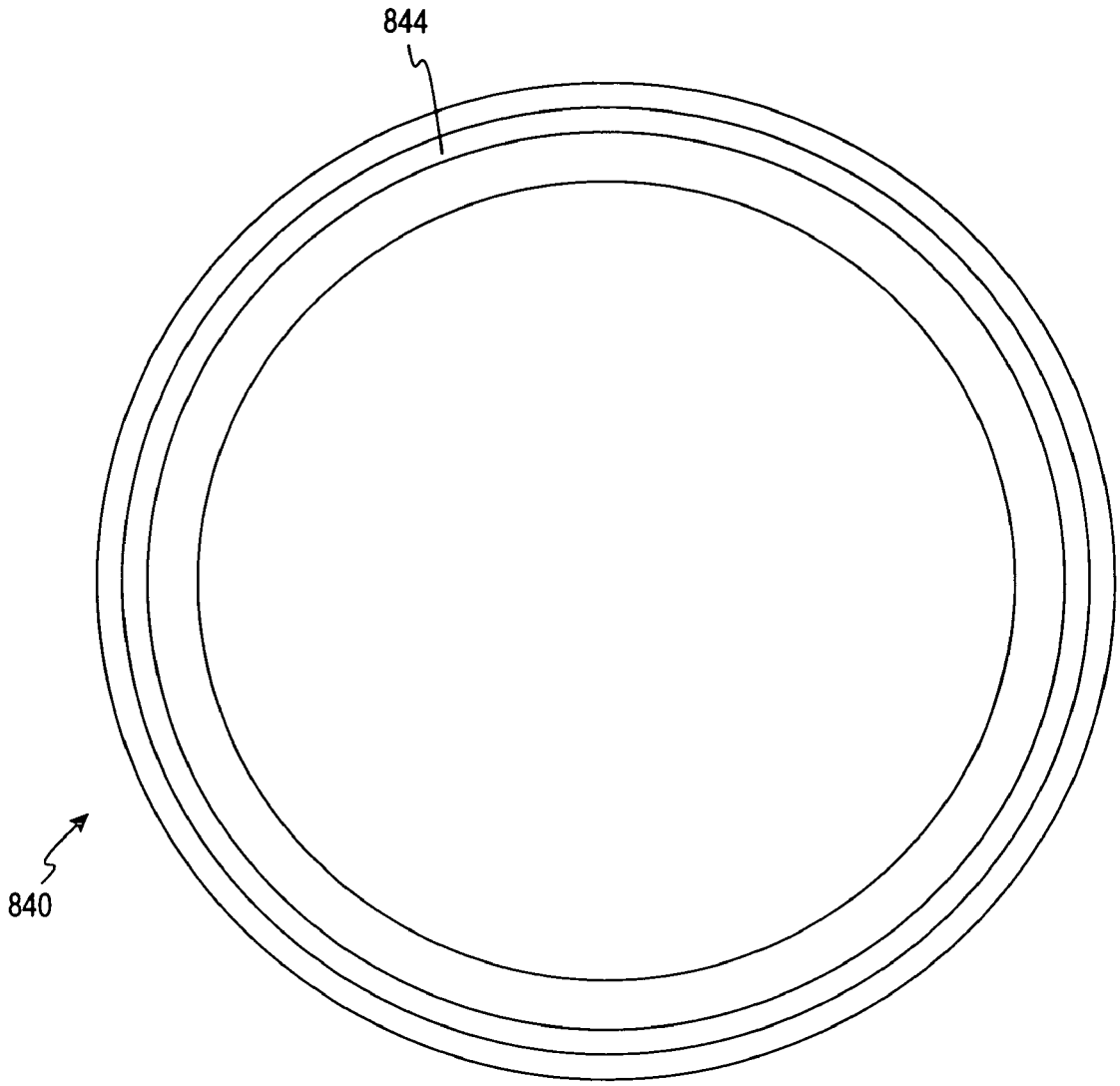
FIG. 24*c* is a top view of the connecting member used in the container assembly of FIG. 24*a*.

Referring to FIGS. 24*a-c*, another modular container assembly 810 is shown. The modular container assembly 810 includes the first container 620, the second container 660 and a connecting member 840. As shown in FIG. 24*c*, the connecting member 840 is a hollow ring and includes extensions 842, 844. The first container 620 is adapted to be releasably engageable with the second container 660 in an inverted position via the connecting member 740. Specifically, extension 842 of the connecting member 840 is fit into the groove 618 and extension 844 of the connecting member 740 is fit into the groove 668 to releasably engage the first container 620 to the second container 660. After the connecting member releasably engages the first container 620 and the second container 660, the modular container assembly 810 is formed as shown in FIG. 24*b*.

Figure 25A:
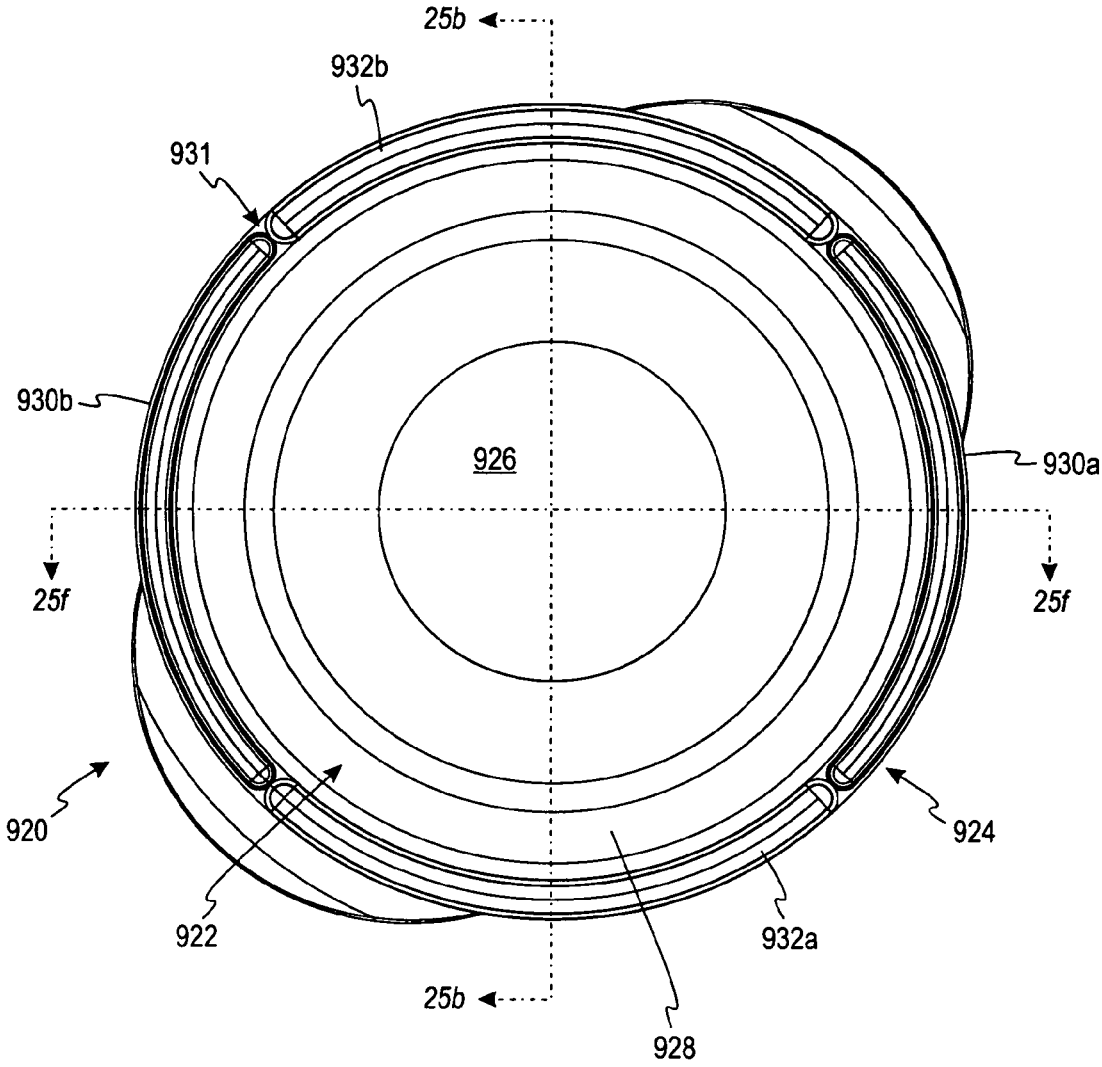
FIG. 25*a* is a top view of a container having a rib and groove to be used in a modular container assembly according to another embodiment.
Figure 25B:
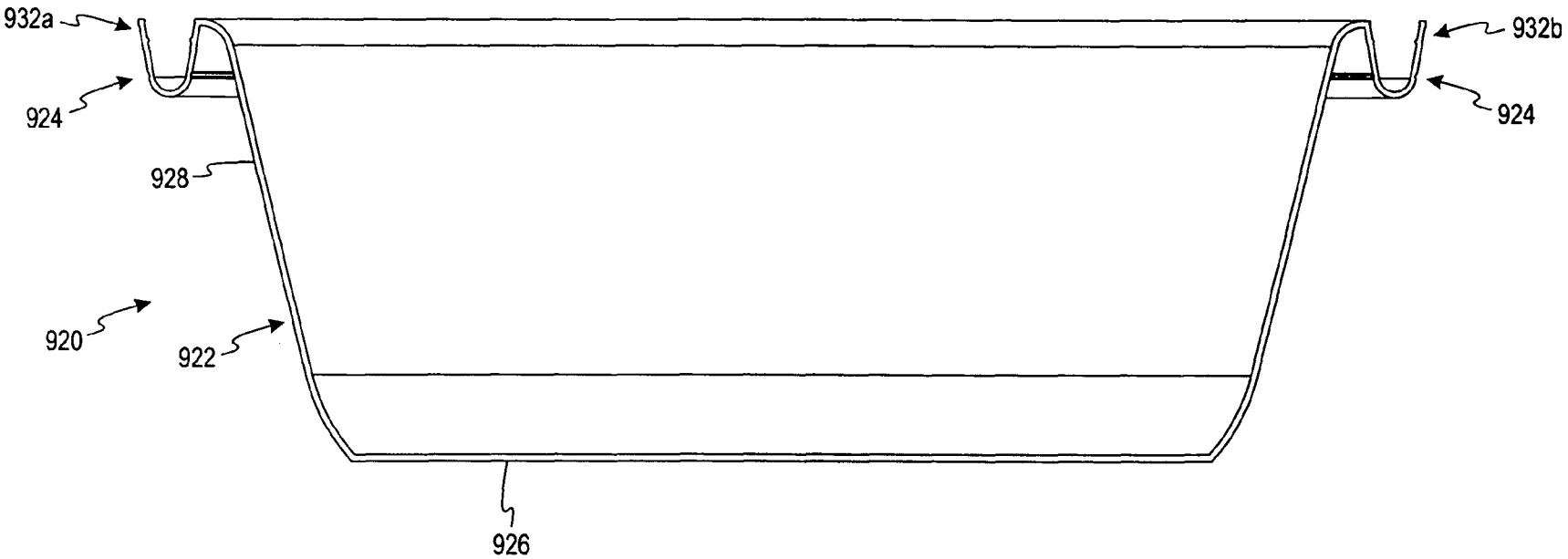
FIG. 25*b* is a cross-sectional view taken generally along line 25*b*-25*b* of FIG. 25*a*.
Figure 25C:
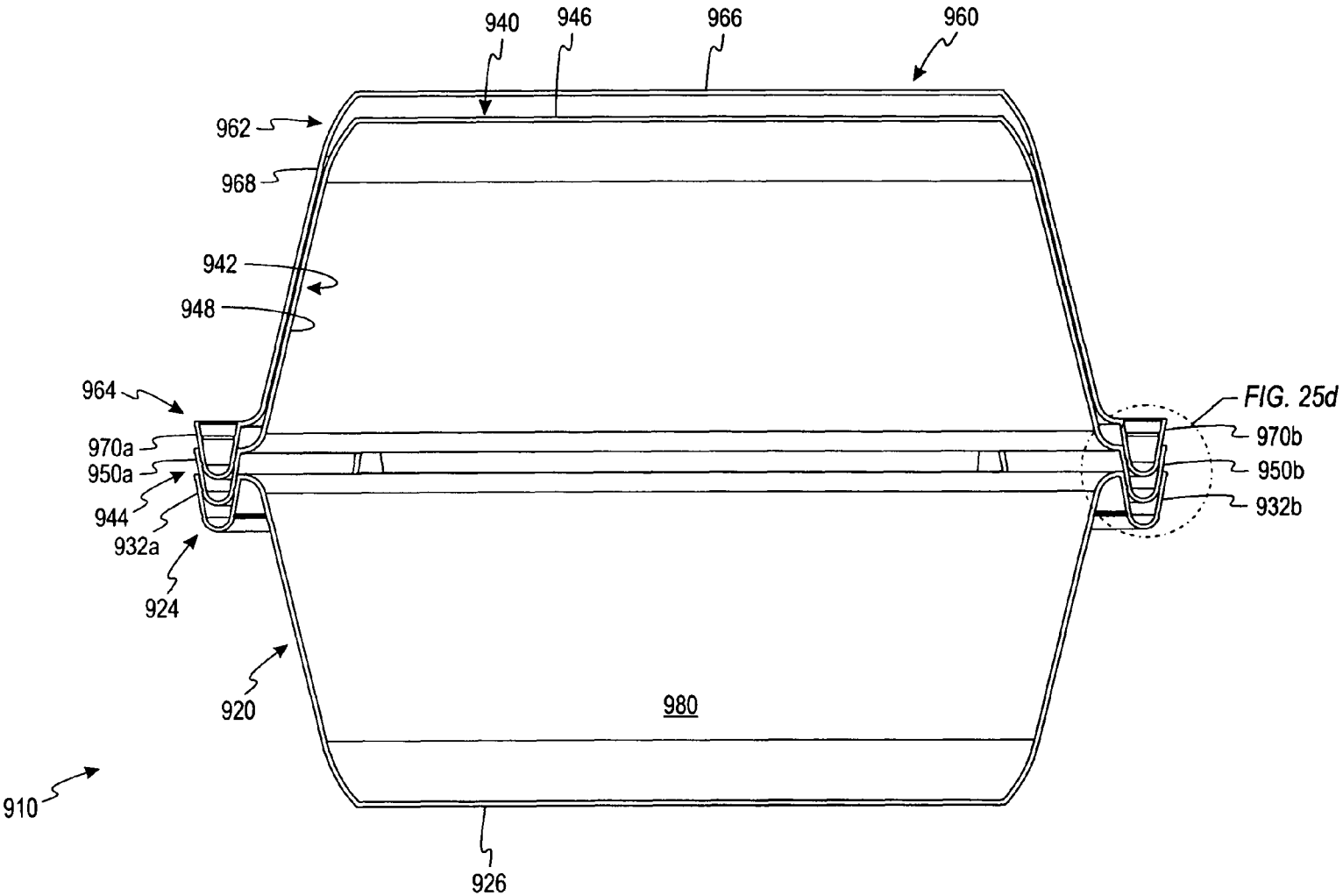
FIG. 25*c* is a side view of a modular container assembly using the container of FIG. 25*a* and two other identical containers with a rib and groove.
Figure 25D:
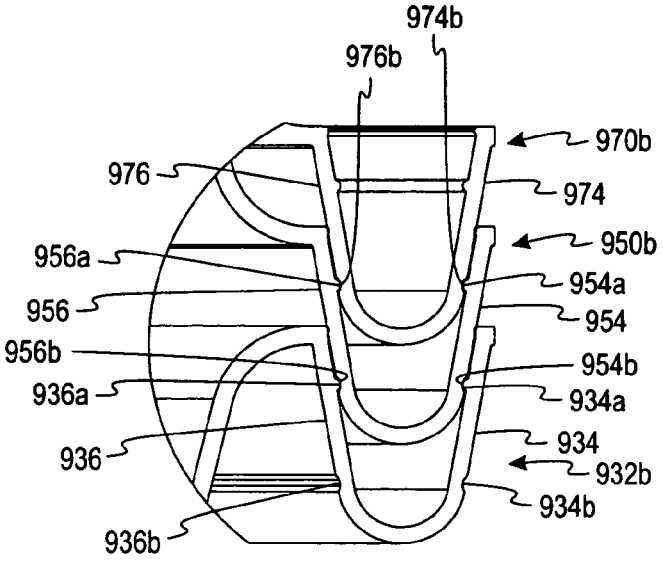
FIG. 25*d* is an enlarged view of generally circular region FIG. 25*d* of FIG. 25*c*.
Figure 25E:
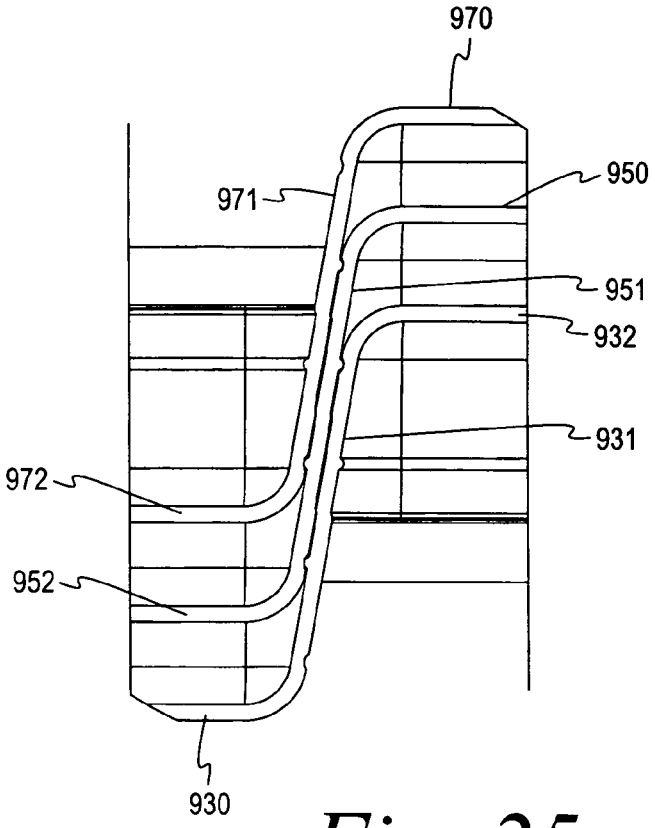
FIG. 25*e* is an enlarged view of a transition region of the modular container assembly of FIG. 25*c*.
Figure 25F:
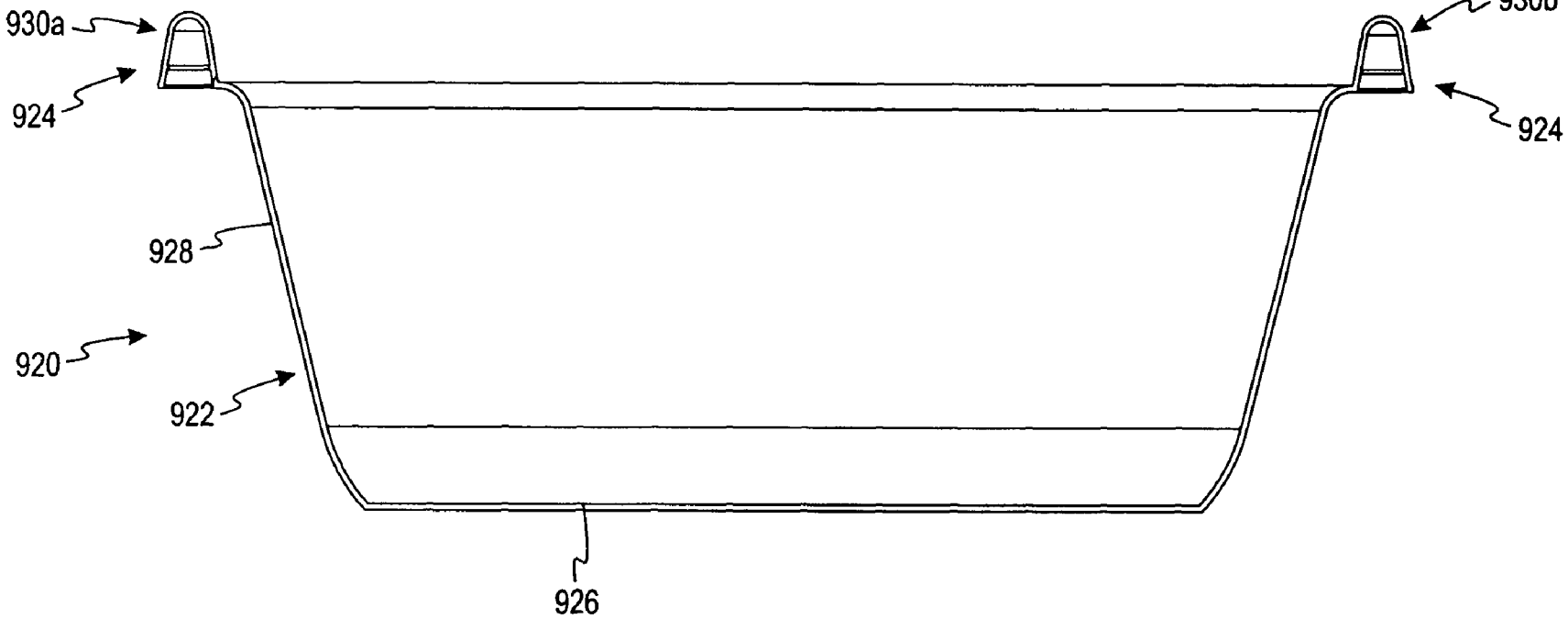
FIG. 25*f* is a cross-sectional view taken generally along line 25*f*-25*f* of FIG. 25*a*.
Figure 25G:
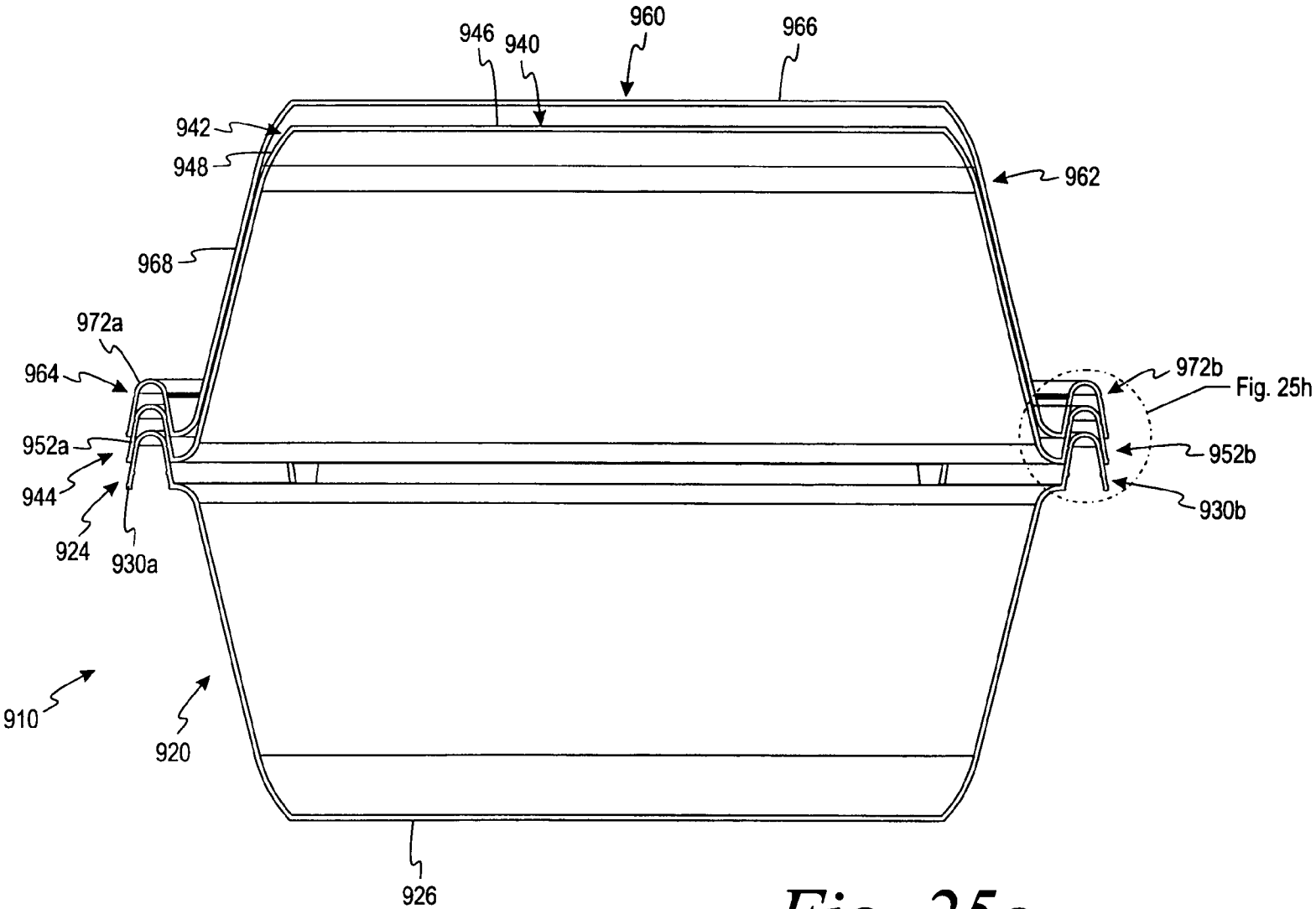
FIG. 25*g* is another side view of a modular container assembly using the container of FIG. 25*a* and two other identical containers with a rib and groove.

Referring to FIGS. 25*c*, 25*g*, a modular container assembly 910 is shown according to another embodiment. The modular container assembly 910 includes a first container 920, a second container 940 and a third container 960. FIGS. 25*c*, 25*g* depict the modular container assembly 910 in an assembled position. Referring to FIGS. 25*a*, 25*b*, 25*f*, the first container 920 used in the modular container assembly 910 includes a continuous body portion 922 and a continuous rim 924 encompassing and projecting laterally outwardly from the body portion 922. The body portion 922 includes a bottom 926 and a continuous sidewall 928 encompassing and projecting upwardly and outwardly from the bottom 926. It is also contemplated that the rim may not be continuous, although it is preferred to be continuous.

The continuous rim 924 includes at least one first feature (i.e., a plurality of ribs 930*a,b*) that projects generally upwardly therefrom and at least one second feature formed therein (i.e., plurality of grooves 932*a,b*). As shown in FIG. 25*a*, each of the ribs 930*a,b* extends generally around about one-quarter of the circumference of the container 920 and each of the grooves 932*a,b* extends generally around one-quarter of the circumference of the container 920. It is contemplated that a container may include exactly one rib and exactly one groove. The containers 940 and 960 include the same features as the container 920.

The groove 932*b*, which is shown in the container assembly of FIG. 25*d*, includes first and second sidewalls 934, 936. First sidewall 934 includes a projection 934*a* and also forms a recess 934*b*. Similarly, second sidewall 936 includes a projection 936*a* and also forms a recess 936*b*. As shown in FIG. 25*d*, projections 934*a*, 936*a* of the first container 920 engage respective recesses 954*b*, 956*b* of the second container 940. The groove 932*a* has the same features as groove 932*b* of FIG. 25*d*.

In addition to the first container 920, as discussed above, the modular container assembly 910 of FIGS. 25*c*, 25*g* includes the second container 940 and the third container 960. The second container 940 includes a continuous body portion 942 and a continuous rim 944 encompassing and projecting laterally outwardly from the body portion 942. The body portion 942 includes a bottom 946 and a continuous sidewall 948 encompassing and projecting upwardly and outwardly from the bottom 946. The continuous rim 944 includes at least one first feature (i.e., plurality of ribs 950*a,b*) that projects generally upwardly therefrom and at least one second feature (i.e., plurality of grooves 952*a,b*). The ribs 950*a,b* and the grooves 952*a,b* are the same as described above with respect to the ribs 930*a,b* and the grooves 932*a,b*.

The third container 960 includes a continuous body portion 962 and a continuous rim 964 encompassing and projecting laterally outwardly from the body portion 962. The body portion 962 includes a bottom 966 and a continuous sidewall 968 encompassing and projecting upwardly and outwardly from the bottom 966. The continuous rim 964 includes a feature (i.e., plurality of ribs 970*a,b*) that projects generally upwardly therefrom and a feature (i.e., plurality of grooves 972*a,b*). The ribs 970*a,b* and the grooves 972*a,b* are the same as described above with respect to the ribs 930*a,b* and the grooves 932*a,b*.

The containers 920, 940 and 960 are the same, including their height. It is contemplated that the containers of the modular container assembly with the above-described rims 924, 944 and 964 may be of different heights such as with the container assembly 210 of FIGS. 12*a,b*. The rims 924, 944 and 964 of respective containers 920, 940 and 960 are identical. It is contemplated that the rims may be substantially identical.

The containers that form the modular container assembly 910 are depicted as being generally circular. The shape of the modular container assembly may vary from that shown without departing from the scope of the invention. It is contemplated that the containers used to form the modular container assembly herein may be other shapes such as rectangular, square, hexagonal, octagonal, other polygonal shapes, oval or other non-polygonal shapes.

Figure 25H:
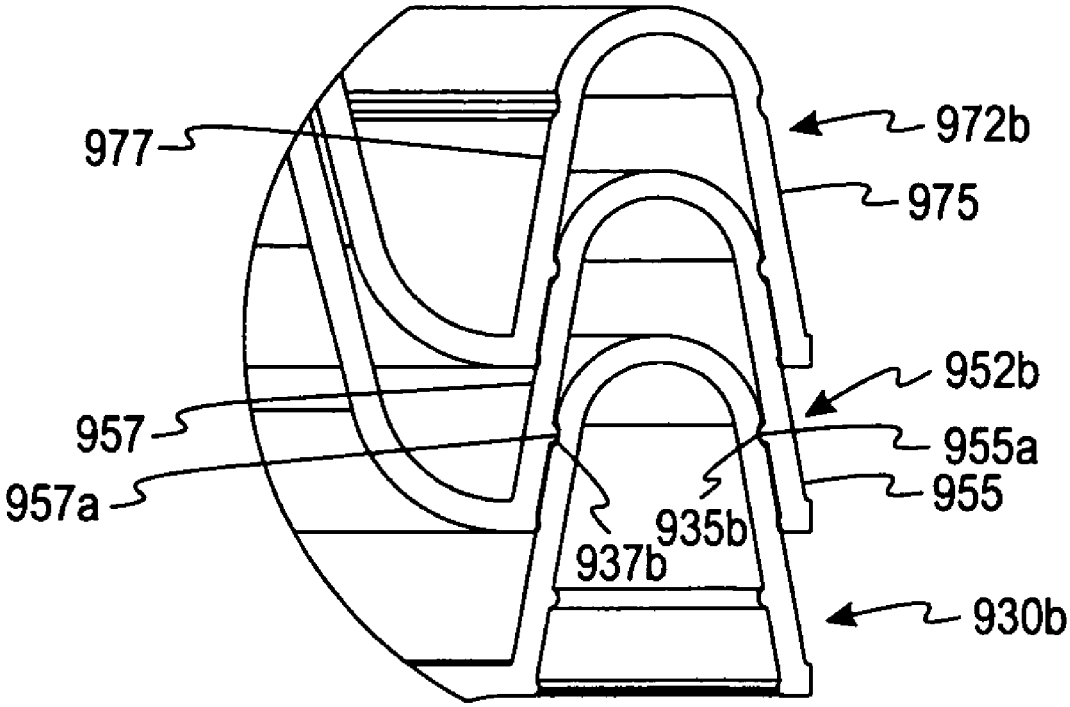
FIG. 25*h* is an enlarged view of generally circular region FIG. 25*h* of FIG. 25*g*.

As specifically shown in FIGS. 25*c*, 25*h* the second and third containers 940, 960 are inverted with respect to the first container 920. The interaction between the ribs and grooves is shown in more detail in FIGS. 25*d*, 25*h*. As shown in FIG. 25*d*, the rib 950*b* of the second container 940 releasably engages the rib 970*b* of the third container 960. Projections 954*a*, 956*a* and corresponding recesses 974*b*, 976*b* of FIG. 25*d* releasably engage each other. Specifically, sidewall portions 974, 976 of the rib 970*b* partially fit within sidewall portions 954, 956 of the rib 950*b*. Referring still to FIG. 25*d*, the groove 932*b* of the first container 920 releasably engages the rib 950*b* of the second container 940. The rib 950*b* partially extends into the interior of the groove 932*b*.

As shown in FIG. 25*h*, the groove 972*b* of the third container 960 releasably engages the groove 952*b* of the second container 940. Specifically, sidewall portions 955, 957 of the groove 952 partially fit within sidewall portions 975, 977 of the groove 972*b*. Referring still to FIG. 25*h*, the groove 952*b* of the second container 940 releasably engages the rib 930*b* of the first container 920. The rib 930*b* partially extends into the interior of the groove 952*b*. The projections 955*a*, 957*a* and corresponding recesses 935*b*, 937*b* releasably engage each other.

The transition of the ribs and the grooves in the modular container assembly 910 is shown in detail in FIG. 25*e*. Specifically, in the third container 960, a transition 971 is formed between one of the ribs 970 and one of the grooves 972. In the second container 940, a transition 951 is formed between one of the ribs 950 and one of the grooves 952. In the first container 920, a transition 931 is formed between one of the ribs 930 and one of the grooves 932. Each of the transitions 931, 951 and 971 is substantially vertical. It is contemplated that the slope of the transition may vary from that shown in FIG. 25*e*. The slope of the transition between one of the ribs and one of the grooves generally ranges from about 2 to about 20 degrees and, more specifically, from about 5 to about 15 degrees as measured from a horizontal plane. The slope of the transition is dependent on the material thickness and the stack height between adjacent containers. It is desirable to optimize the slope of the transition to obtain a seal between the containers at this region.

As shown in FIG. 25*a*, the rib 930*a* and groove 932*a* of the first container has the transition region 931 formed therebetween. The transition region 931 in one embodiment has a contact area so as to prevent or inhibit food or liquid from leaving the interior of the container assembly. The contact area desirable has sufficient pressure to prevent or inhibit food or liquid from leaving the container. The smaller the contact area, the more contact pressure may be obtained on that area.

Referring back to FIG. 25*c* after the modular container assembly 910 is formed into an assembled position, an area 980 is formed between the first and second containers 920, 940. The container assembly 910 may contain first and second items. The first and second food items may be the same or may be different. The first and/or second food item may be a liquid. It is contemplated that other foods may be stored in the modular container assembly 910. It is also contemplated that additional areas may be formed if the containers were of different heights.

To form the modular container assembly 910, the first container 920, the second container 940 and the third container 960 are provided. The second container 940 and the third container 960 are aligned such that the second rim 944 and the third rim 964 are adjacent to each other. The upwardly-projecting features (i.e., plurality of ribs 970*a,b*) of the third container 960 partially fit into a respective one of the upwardly-projecting features (i.e., plurality of ribs 950*a,b*) of the second container 940. The grooves 952*a,b* of the second container 940 partially fit into a respective one of the grooves 972*a,b* of the third container 960 such that the second and the third containers 940, 960 are releasably engaged to each other. To partially fit the ribs 970*a,b* into a respective one of the ribs 950*a,b*, the container 940 or the container 960 may have to be rotated slightly such that the ribs 950*a,b*, 970*a,b* are aligned with each other.

The second and third containers 940, 960 are placed in an inverted position relative to the first container 920. For example, the second and third containers 940, 960 may be flipped 180 degrees relative to the first container 920. The first and second containers 920, 940 are aligned such that the rims 924, 944 are adjacent to each other. The upwardly-projecting features (e.g., plurality of ribs 930*a,b*) of the first container 920 partially fit into a respective one of the grooves 952*a,b* of the second container 940 and the ribs 950*a,b* of the second container 940 fit into a respective one of the grooves 932*a,b* of the first container 920 such that the first and the second containers 920, 940 are releasably engaged to each other and form the area 980.

The modular container assemblies of the present invention are typically formed from polymeric materials, but may be formed from materials such as paper or metal. The polymeric containers may be formed from polyolefins. The polymeric containers are typically formed from orientated polystyrene (OPS), polyethylene terephthalate (PET), polyvinyl chloride (PVC), polypropylene and combinations thereof. It is contemplated that one of ordinary skill in the art will recognize that other polymers or combinations of polymers may be used to form the containers. The modular containers assemblies may be made from a mineral-filled polymeric material such as, for example, talc or calcium carbonate-filled polyolefin. An example of paper that may be used in forming the container assemblies is paperboard or molded fiber. Paperboard and molded fiber typically have a sufficient coefficient of friction to maintain the first and second containers in an engageable position.

As discussed, the materials used in forming the modular container assembly may assist in releasably engaging the container assembly. For example, the material(s) forming the modular container assembly may have a fairly tacky laminate on one side that corresponds with a fairly tacky laminate on the opposing side, resulting in a desirable releasably engageable container assembly.

It is contemplated that the containers used in forming the modular container assemblies may be made from different materials. It is contemplated that one of ordinary skill in the art will recognize that other polymers or combination of polymers may be used to form the containers.

The modular container assemblies of the present invention are typically disposable, but it is contemplated that they may be reused at a future time. The containers used in forming the modular container assemblies (e.g., container 20) are shown as including one compartment. It is contemplated that the containers may be formed of multiple compartments.

As discussed above, the container assemblies may be used with food items. A method of using such container assemblies includes placing the food and engaging the containers to form a modular container assembly with food therein. The container assembly is then placed in a heating apparatus and heated. Typical heating apparatuses include microwaves and conventional ovens. The container assemblies may contain solid food products. The container assemblies may be used for storage in the refrigerator and/or the freezer.

The containers to be used in forming the modular container assemblies of the present invention may be formed using conventional thermoforming (e.g., by pressure, vacuum or the combination thereof), injection-molding processes, or rotational molding. According to one method of thermoforming, pellets of a polymeric resin and additives, if any, are added into an extruder. The pellets of the polymeric resin and additives, if any, are melted to form a blend. The blend is extruded through a die to form an extruded sheet. The extruded sheet is thermoformed to a desired shape of a container to be used in forming the container assembly.

The thickness of the container to be used in forming the container assemblies generally ranges from about 0.002 to about 0.15 inch, but is typically from about 0.005 to about 0.04 inch. The modular container assemblies may be opaque or a variety of colors or color combinations. The container assemblies typically have at least one translucent or transparent container if it is desired for the customer to ascertain the nature of the accommodated product and the condition thereof without having to open the modular container assembly. It is especially desirable to have all of the containers used in the modular container assembly to be translucent and transparent.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A modular container assembly comprising:

a first polymeric container including a first continuous body portion and a first rim, the first rim encompassing and projecting laterally outwardly from the first body portion, the first rim having a first feature projecting generally upwardly therefrom and a corresponding second feature being adapted to be releasably engageable with another one of the first feature;

a second polymeric container including a second continuous body portion and a second rim, the second rim encompassing and projecting laterally outwardly from the second body portion, the second rim having a third feature projecting generally upwardly therefrom and a corresponding fourth feature being adapted to be releasably engageable with another one of the third feature; and a third polymeric container including a third continuous body portion and a third rim, the third rim encompassing and projecting laterally outwardly from the third body portion, the third rim having a fifth feature projecting generally upwardly therefrom and a corresponding sixth feature being adapted to be releasably engageable with another one of the fifth feature, wherein the first rim, the second rim, and the third rim are substantially identical, wherein the first container, the second container, and the third container are releasably engageable to each other by fitting respective first, third and fifth upwardly-projecting features into the corresponding second, fourth or sixth feature of another container or into the first, third or fifth upwardly-projecting feature of another container, wherein at least one of the first container, second container, and third container is inverted with respect to the remaining containers so as to form a modular container assembly.

2. The container assembly of claim 1 wherein the first container and the second container are identical.

3. The container assembly of claim 1 wherein the first container, the second container, and the third container are of different shapes.

4. The container assembly of claim 1 wherein the first rim, the second rim, and the third rim are identical.

5. The container assembly of claim 1 wherein the first container, the second container, and the third container are generally circular.

6. The container assembly of claim 1 wherein the first container, the second container, and the third container are of a polygonal shape.

7. The container assembly of claim 1 wherein the first container, the second container, and the third container are generally translucent.

8. The container assembly of claim 1 wherein the first container, the second container, and the third container are made of a mineral-filled polymeric material.

9. The container assembly of claim 1 wherein the first rim, the second rim, and the third rim are adapted to form a seal.

10. The container assembly of claim 1 wherein a first area is formed between the first container and the second container, and a second area is formed between the second container and the third container, the first area and the second area being distinct from each other.

11. The container assembly of claim 1 wherein the modular container assembly includes a first non-food item and a second non-food item.

12. The container assembly of claim 1 wherein the first, third and fifth features are ribs, and the second, fourth and sixth features are grooves.

13. The container assembly of claim 1 wherein the first container includes a plurality of the first upwardly-projecting features and a plurality of the corresponding second features, the second container includes a plurality of the third upwardly-projecting features and a plurality of the corresponding fourth features, the third container includes a plurality of the fifth upwardly-projecting features and a plurality of the corresponding sixth features.

14. The container assembly of claim 13 wherein the plurality of first, third and fifth upwardly-projecting features are ribs and wherein the corresponding, second, fourth and sixth features are respective spaces formed between the first, third and fifth features.

15. A modular container assembly containing and holding food, the assembly comprising:

a first polymeric container including a first continuous body portion and a first rim, the first rim encompassing and projecting laterally outwardly from the first body portion, the first rim having a first feature projecting generally upwardly therefrom and a corresponding second feature being adapted to be releasably engageable with another one of the first feature;

a second polymeric container including a second continuous body portion and a second rim, the second rim encompassing and projecting laterally outwardly from the second body portion, the second rim having a third feature projecting generally upwardly therefrom and a corresponding fourth feature being adapted to be releasably engageable with another one of the third feature; and a third polymeric container including a third continuous body portion and a third rim, the third rim encompassing and projecting laterally outwardly from the third body portion, the third rim having a fifth feature projecting generally upwardly therefrom and a corresponding sixth feature being adapted to be releasably engageable with another one of the fifth feature, wherein the first rim, the second rim, and the third rim are substantially identical, wherein the first container, the second container, and the third container are releasably engageable to each other by fitting respective first, third and fifth upwardly-projecting features into the corresponding second, fourth or sixth feature of another container or into the first, third or fifth upwardly-projecting feature of another container, wherein at least one of the first container, second container, and third container is inverted with respect to the remaining containers so as to form a modular container assembly with a first area being formed between the first container and the second container, and a second area being formed between the second container and the third container, the first area and the second area being distinct from each other, the first area containing a first food and the second area containing a second food.

16. The container assembly of claim 15 wherein the first food and the second food are the same.

17. The container assembly of claim 15 wherein the first food and the second food are different.

18. The container assembly of claim 15 wherein at least one of the first food and the second food is a liquid.

19. A modular container assembly comprising:

a first polymeric container including a first continuous body portion and a first rim, the first rim encompassing and projecting laterally outwardly from the first body portion, the first rim having a first feature projecting generally upwardly therefrom and a corresponding second feature being adapted to be releasably engageable with another one of the first feature;

a second polymeric container including a second continuous body portion and a second rim, the second rim encompassing and projecting laterally outwardly from the second body portion, the second rim having a third feature projecting generally upwardly therefrom and a corresponding fourth feature being adapted to be releasably engageable with another one of the third feature;

a third polymeric container including a third continuous body portion and a third rim, the third rim encompassing and projecting laterally outwardly from the third body portion, the third rim having a fifth feature projecting generally upwardly therefrom and a corresponding sixth feature being adapted to be releasably engageable with another one of the fifth feature; and a fourth polymeric container including a fourth continuous body portion and a fourth rim, the fourth rim encompassing and projecting laterally outwardly from the fourth body portion, the fourth rim having a seventh feature projecting generally upwardly therefrom and a corresponding eighth feature being adapted to be releasably engageable with another one of the seventh feature, wherein the first rim, the second rim, the third rim, and the fourth rim are identical, wherein the first container, the second container, the third container, and the fourth container are releasably engageable to each other by fitting respective first, third, fifth and seventh upwardly-projecting features into the corresponding second, fourth, sixth or eighth feature of another container or into the first, third, fifth or seventh upwardly-projecting feature of another container, wherein at least one of the first container, second container, third container, and the fourth container is inverted with respect to the remaining containers so as to form a modular container assembly.

20. The container assembly of claim 19 wherein the first container and second container are identical.

21. The container assembly of claim 20 wherein the third container and the fourth container are identical.

22. The container assembly of claim 19 wherein the first container, the second container, the third container, and the fourth container have at least three different shapes.

23. The container assembly of claim 22 wherein the first container, the second container, the third container, and the fourth container are of different shapes.

24. The container assembly of claim 19 wherein two of the first container, the second container, the third container, and the fourth container are inverted with respect to the two other containers.

25. A modular container assembly containing and holding food, the assembly comprising:

a first polymeric container including a first continuous body portion and a first rim, the first rim encompassing and projecting laterally outwardly from the first body portion, the first rim having a first feature projecting generally upwardly therefrom and a corresponding second feature being adapted to be releasably engageable with another one of the first feature;

a second polymeric container including a second continuous body portion and a second rim, the second rim encompassing and projecting laterally outwardly from the second body portion, the second rim having a third feature projecting generally upwardly therefrom and a corresponding fourth feature being adapted to be releasably engageable with another one of the third feature;

a third polymeric container including a third continuous body portion and a third rim, the third rim encompassing and projecting laterally outwardly from the third body portion, the third rim having a fifth feature projecting generally upwardly therefrom and a corresponding sixth feature being adapted to be releasably engageable with another one of the fifth feature; and a fourth polymeric container including a fourth continuous body portion and a fourth rim, the fourth rim encompassing and projecting laterally outwardly from the fourth body portion, the fourth rim having a seventh feature projecting generally upwardly therefrom and a corresponding eighth feature being adapted to be releasably engageable with another one of the seventh feature, wherein the first rim, the second rim, the third rim, and the fourth rim are identical, wherein the first container, the second container, the third container, and the fourth container are releasably engageable to each other by fitting respective first, third, fifth and seventh upwardly-projecting features into the corresponding second, fourth, sixth or eighth feature of another container or into the first, third, fifth or seventh upwardly-projecting feature of another container, wherein at least one of the first container, second container, third container, and the fourth container is inverted with respect to the remaining containers so as to form a modular container assembly with a first area being formed between the first container and the second container, a second area being formed between the second container and the third container, and a third area being formed between the third container and the fourth container, the first area, the second area and the third area being distinct from each other, the first area containing a first food, the second area containing a second food and the third area containing a third food.

26. The container assembly of claim 25 wherein the first food and the second food are the same.

27. The container assembly of claim 25 wherein the first food, the second food and the third food are different.

28. The container assembly of claim 25 wherein at least one of the first food, second food and the third food is a liquid.

29. A merchandizing container display comprising:

a plurality of first containers including a first continuous body portion and a first rim, the first rim encompassing and projecting laterally outwardly from the first body portion, the first rim having a first feature projecting generally upwardly therefrom and a corresponding second feature being adapted to be releasably engageable with another one of the first feature;

a plurality of second containers including a second continuous body portion and a second rim, the second rim encompassing and projecting laterally outwardly from the second body portion, the second rim having a third feature projecting generally upwardly therefrom and a corresponding fourth feature being adapted to be releasably engageable with another one of the third feature; and a plurality of third containers including a third continuous body portion and a third rim, the third rim encompassing and projecting laterally outwardly from the third body portion, the third rim having a fifth feature projecting generally upwardly therefrom and a corresponding sixth feature being adapted to be releasably engageable with another one of the fifth feature, the first rim, the second rim and the third rims being substantially identical, wherein the first container, the second container, and the third container are of different sizes, wherein each of the plurality of first containers is releasably engageable to another one of the plurality of first containers by fitting the first upwardly-projecting feature of a first container into the first upwardly-projecting feature of another first container, wherein each of the plurality of second containers is releasably engageable to another one of the plurality of second containers by fitting the third upwardly-projecting feature of a second container into the third upwardly-projecting feature of another second container, wherein each of the plurality of third containers is releasably engageable to another one of the plurality of third containers by fitting the fifth upwardly-projecting feature of a third container into the fifth upwardly-projecting feature of another third container.

30. The display of claim 29 further including a plurality of fourth containers having a fourth continuous body portion and a fourth rim, the fourth rim encompassing and projecting laterally outwardly from the fourth body portion, the fourth rim having a seventh feature projecting generally upwardly therefrom and a corresponding eighth feature being adapted to be releasably engageable with another one of the seventh feature, wherein the first rim, the second rim, the third rim and the fourth rim are substantially identical, and wherein each of the plurality of fourth containers is releasably engageable to another one of the plurality of fourth containers by fitting the seventh upwardly-projecting feature of a fourth container into the seventh upwardly-projecting feature of another fourth container.

31. A modular container assembly comprising:

a first polymeric container including a first continuous body portion and a first rim, the first rim encompassing and projecting laterally outwardly from the first body portion, the first rim having a first feature;

a second polymeric container including a second continuous body portion and a second rim, the second rim encompassing and projecting laterally outwardly from the second body portion, the second rim having a second feature; and a polymeric connecting member being adapted to releasably engage with the first container and an inverted second container, the connecting member being a container, wherein the first container and the second container are substantially identical, wherein the first container and the second container are releasably engaged to each other by fitting respective first and second features of the first and second containers with the connecting member, wherein the second container is inverted with respect to the first container to form a modular container assembly.

32. The container assembly of claim 31 wherein at least one of the first and second features are grooves.

* * * * *